United States Patent [19]

Shinkai et al.

[11] Patent Number: 5,067,204

[45] Date of Patent: Nov. 26, 1991

[54] METHOD FOR CONTINUOUSLY SUPPLYING SLIVERS TO A ROVING FRAME

[75] Inventors: Kunio Shinkai, Handa; Toyoo Suzuki, Nishio; Yukitaka Nomura, Gifu; Yoshio Kurachi, Nishikasugai; Hiroyuki Kureishi, Nagoya, all of Japan

[73] Assignee: Howa Machinery Ltd., Japan

[21] Appl. No.: 495,912

[22] Filed: Mar. 20, 1990

[30] Foreign Application Priority Data

Mar. 23, 1989 [JP] Japan ..... 1-71310

[51] Int. Cl.[5] ..... D01H 9/18; B65H 67/08

[52] U.S. Cl. ..... 19/159 A; 57/266

[58] Field of Search ..... 19/159 A; 198/465.1; 57/22, 23, 266, 267, 269-271

[56] References Cited

U.S. PATENT DOCUMENTS

| | | | |
|---|---|---|---|
| 3,681,905 | 9/1972 | Furtmeter et al. | 57/267 X |
| 4,042,093 | 8/1977 | Fujji et al. | 19/159 A X |
| 4,083,170 | 4/1978 | Raasch | 19/159 A X |
| 4,150,534 | 4/1979 | Raasch | 19/159 A X |
| 4,227,848 | 10/1980 | Kriechbaum et al. | 19/159 A X |
| 4,537,018 | 8/1985 | Tooka | 57/266 X |
| 4,642,851 | 2/1987 | Hera | 19/159 A |
| 4,697,310 | 10/1987 | Raasch | 19/159 A |
| 4,735,040 | 4/1988 | Pircher | 19/159 A X |
| 4,866,814 | 9/1989 | Carbonetto | 19/159 A |
| 4,875,256 | 10/1989 | Gumkinger | 19/159 A |

FOREIGN PATENT DOCUMENTS

| | | | |
|---|---|---|---|
| 3089282 | 9/1989 | Fed. Rep. of Germany | 19/159 A |
| 3717778 | 10/1962 | Japan | 19/159 A |

*Primary Examiner*—Werner H. Schroeder
*Assistant Examiner*—John J. Calvert
*Attorney, Agent, or Firm*—Stevens, Davis, Miller & Mosher

[57] ABSTRACT

A method and apparatus for continuously supplying slivers mechanically to a roving frame, wherein a plurality of aligned sliver cans are arranged along the longitudinal direction of the roving frames in a taper arrangement with regard to the volume of sliver contained therein-full packaged sliver cans are aligned at a standby position adjacent to and facing the aligned sliver cans which contain the smallet volume of sliver therein, and when the above-mentioned sliver cans having the smallest volume of sliver reach an almost exhausted condition, a unit sliver piecing operation of piecing a free end of sliver from one of each of the full packaged sliver cans with a free end of each sliver supplied to the roving frame, created by separating same from each sliver supplying can facing thereto, is carried out in steps at all of the above-mentioned full packaged sliver cans. When the packaged sliver cans are at the standby positions thereof, a position of an end of a sliver from each of the full packaged sliver cans is regulated to a predetermined angular position with respect to the longitudinal axis of the sliver can.

4 Claims, 17 Drawing Sheets

METHOD FOR CONTINUOUSLY SUPPLYING SLIVERS TO A ROVING FRAME

BACKGROUND OF THE INVENTION

1. Technical Field of the Invention

The present invention relates to a method and apparatus for supplying slivers to a roving frame. More particularly, it relates to a method and apparatus for continuously supplying slivers to a roving frame.

2. Description of the Related Art

Japanese Examined Patent Publication Showa 46 (1971)-6544, Japanese Examined Patent Publication Showa 41 (1966)-2739, and Japanese Examined Patent Publication Showa 42 (1962)-6015 disclose methods and apparatuses for exchanging almost exhausted sliver cans with corresponding full packaged sliver cans, after the end portion of a sliver contained in each almost exhausted sliver can is pieced with the free end of a sliver contained in the corresponding full packaged sliver can obtained from a prior process.

In the first-mentioned related art, a conveyer is arranged at a position right behind a roving frame along the longitudinal direction thereof, and a number of groups of sliver supply cans supplying slivers to the roving frame, which number is identical to the number of spindles of the roving frame, are arranged in an alignment perpendicular to the longitudinal direction of and right behind the conveyer, so that slivers supplied from these sliver supply cans of each group are introduced to corresponding draft mechanisms of the roving frame, which are adjacent to each other. The above-mentioned sliver supply cans is hereinafter simply referred to as a sliver can. The volume of sliver contained in the sliver cans of each group is preset in a "taper" arrangement; for example, if each group is composed of 3 sliver cans, the sliver cans positioned nearest to the conveyer contain almost one-third of the full packaged volume, the following sliver cans contain almost two-thirds of the full packaged volume, and the sliver cans positioned farthest from the conveyer contain almost full packaged volume. Therefore, during the operation of the roving frame, the sliver cans of each group nearest to the conveyer are always exhausted after a constant time has passed. Therefore, in the first related art, when the sliver cans positioned nearest to the conveyer become exhausted, in each group of sliver cans, the above-mentioned exhausted sliver cans are displaced from the conveyer and transported to a terminal position near a frame end of the roving frame, while still supplying a sliver to the corresponding draft part of the roving frame via the corresponding sliver guide roller. When the end of the sliver contained in these sliver cans is displaced upward, so that an end thereof appears, this end of the sliver is pieced with a free end of a sliver from the full packaged sliver cans which have been carried to a standby position close to the above-mentioned terminal position. After completion of the above-mentioned sliver piecing operation, the completely exhausted sliver cans are displaced to a position outside the sliver supply position at the roving frame, and the above-mentioned full packaged sliver cans, at which the sliver piecing operation is completed, are displaced to the normal sliver supplying position at the roving frame. The above-mentioned combined sliver cans exchange and sliver piecing operations are repeatedly carried out for all sliver cans from which slivers are supplied to the corresponding draft parts of the roving frame. This related art, however, does not make any particular disclosure of how to piece the two sliver ends.

In the second related art, a sliver from a full packaged sliver can is positioned above a sliver from a sliver can, which will soon be exhausted, during the displacement of the full packaged sliver cans, is gripped by a pair of rollers, and then a free end of the sliver delivered from the rollers is separated by sucking this portion by means of a suction means. On the other hand, a free end of a sliver from a sliver supplying can, which will soon be exhausted, is also separated from the upstream portion of the supplied sliver passing through another pair of feed rollers, just before this free end of the supplied sliver is introduced to the nip point of the feed rollers, so that the separated end of the sliver from the full packaged sliver cans is doubled over the separated free end of the supplied sliver just before being introduced to the feed rollers, by introducing the above-mentioned separated portion of the sliver from the full packaged sliver can downwardly to the position at which the sliver is fed to the feed rollers, so that a sliver end piecing operation can be carried out.

In the third related art, the arrangement of the sliver cans behind the roving frame is divided into a number of groups in such a way that, in each group of sliver cans, which are positioned in alignment with each other, along a direction perpendicular to the longitudinal direction of the roving frame, the volume of sliver contained in those sliver cans is preset in a "taper" arrangement, for example, in each group arrangement of four sliver cans, the volume of sliver contained in the first sliver cans positioned nearest to the roving frame is almost equal to the full packaged volume, the volume of the subsequent sliver cans is three-fourths of the full packaged volume, the volume of the third group of sliver cans is almost one-half of the full packaged volume, and the last group of sliver cans, positioned farthest from the roving frame, have a volume of almost one-fourth of the full packaged volume. When the last sliver cans are at an almost exhausted condition, the piecing operation of the sliver end from these sliver cans with the sliver end of the full packaged sliver cans already prepared is made by a manual operation, and thereafter, the full packaged sliver cans replacing the almost exhausted sliver cans are displaced to the position at which the above-mentioned first sliver cans were positioned, by displacing the remaining three sliver cans for a distance corresponding to a space for positioning one sliver cans in a direction far from the roving frame. During this operation, the exhausted sliver cans are returned to a prior process.

In the above-mentioned prior art, however, the following problems remain unsolved.

That is, in the above-mentioned first prior art, the above-mentioned exhausted sliver cans are displaced to the terminal position near a frame end of the roving frame, while still supplying a sliver to the corresponding part of the roving frame via the corresponding sliver guide roller, when the piecing operation of the sliver supplied from the above-mentioned sliver cans with a free end of a sliver from a full packaged sliver can is carried out. Accordingly, for example, if sliver cans positioned at an almost longitudinal central portion of the conveyer are subjected to the above-mentioned cans exchanging operation, the length of sliver between an almost exhausted sliver can displaced to the above-mentioned terminal position and the corresponding sliver guide roller becomes so long that treatment of this portion after completion of the above-mentioned sliver piecing operation is very complicated and not practical.

On the other hand, in the above-mentioned second prior art, since full packaged sliver cans are prepared at the respective standby positions adjacent to the respective sliver cans which require a can exchange operation, the above-mentioned problem related to the first prior art cannot be eliminated. That is, the sliver piecing operation must be carried out precisely with respect to time because, in each sliver piecing operation, a free end of a sliver from a full packaged sliver can must be combined with a free end of a sliver being supplied to the feed rollers at a position precisely upstream of the feed rollers. To carry out the above-mentioned sliver piecing operation in the order of arrangement of the sliver cans along the cans alignment which is parallel to the conveyer, it is essential to control the volume of slivers contained in the full packaged sliver cans very precisely, to carry out the operation effectively. However, such a precise volume control of the full packaged sliver cans is not practical. To solve this problem, a simultaneous exchange of almost exhausted sliver cans positioned along the conveyer with respect to full packaged sliver cans may be considered. Even if such a simultaneous exchange operation is applied, however, it is essential to create a condition such that the free end of slivers of the sliver cans are positioned at the respective positions for carrying out the above-mentioned sliver piecing operation, and therefore, the above-mentioned requirement for controlling the volume of slivers contained in the full packaged sliver cans can not be eliminated.

In the third prior art, the can exchanging operation is carried out automatically and the sliver piecing operation is carried out at a position apart from a position upstream of and adjacent to the feed rollers, and thus the very severe requirement regarding the timing, as in the above-mentioned second prior art, can be eliminated. Nevertheless, since the sliver piecing operation is manually carried out, a problem still remains in that a full automatic operation of exchanging sliver cans, which involves an automatic sliver piecing operation, is still not obtained.

SUMMARY OF THE INVENTION

An object of the present invention is to provide a method and apparatus for continuously supplying slivers to a roving frame, which method and apparatus are characterized as follows:

(a) the relative position between a full packaged sliver can and a corresponding feed roller of a creel can be maintained in the same condition, even after the completion of a sliver piecing operation, by carrying out a mechanical operation of piecing a free end of a sliver contained in the above-mentioned full packaged sliver can with an end of a sliver contained in a corresponding almost exhausted sliver can, at a position close to the almost exhausted sliver can.

(b) the above-mentioned sliver piecing operation is applied to the sliver contained in the almost exhausted sliver can from which the sliver is continuously fed to a corresponding draft part of the roving frame, and accordingly, it is not necessary to precisely control the volume of the slivers contained in the sliver cans, and thus strict control of the volume of sliver contained in full packaged sliver cans as in the prior process is not required.

(c) a fully automatic production system used for all of the spinning processes can be introduced by connecting the roving process with the prior process by using transporting equipment for carrying sliver cans from the prior process to the roving process, together with the use of known transporting equipment between the carding process and the drawing process, between the roving process and the fine spinning process such as the ring spinning process, and between the fine spinning process and the winding process.

The above-stated objectives are accomplished in a method for continuously supplying slivers to a roving frame, wherein a plurality groups of sliver cans are arranged along the longitudinal direction of the roving frame at positions behind same, in a condition such that each group of sliver cans is arranged in alignment, and the volume of slivers contained in the sliver cans are prepared in a "tapered" arrangement with respect to the arrangement of the groups of sliver cans wherein the above-mentioned groups of sliver cans are arranged with respective longitudinal spaces therebetween and each longitudinal space is sufficient to arrange two alignments of sliver cans therein.

Under these conditions, a plurality of full packaged sliver cans, of a number equal to the total number of spindles of the roving frame divided by number of alignments of sliver supplying cans, are mechanically carried to the respective standby positions on one side space of a longitudinal space, in a condition facing the corresponding sliver cans, which contain the smallest volume of sliver and feeding sliver to the roving frame, arranged on the other side space of the identical longitudinal space, while each free end of slivers from the above-mentioned full packaged sliver cans is mechanically positioned at a predetermined angular position with respect to the longitudinal axis of the can, just before displacing the full packaged sliver cans to the above-mentioned respective standby positions. Accordingly, when the above-mentioned sliver cans becomes almost exhausted, a sliver piecing operation is applied to the sliver supplying cans and the full packaged sliver supply cans facing each other from one side of the alignment of sliver cans to the other side in such a way that, in each sliver piecing operation, a free end of a sliver of one of the sliver cans, which are feeding the sliver to the roving frame, and a free end of sliver from of the the full packaged sliver cans are pieced together. Thereafter, upon completion of the above-mentioned sliver piecing operation to all of the above-mentioned sliver cans arranged in alignment, the exhausted sliver cans are discharged from the working position of the roving frame.

The above-mentioned sliver piecing operation is carried out in the following two ways. Namely, in the basic invention, in each unit sliver piecing operation, a free end portion of sliver from full packaged sliver cans is first introduced to a position at which the piecing operation is carried out and a fresh free end of sliver is created to be used for the sliver piecing operation. Further, an intermediate portion of sliver from the sliver cans facing the above-mentioned full packaged sliver cans, which are feeding sliver to the roving frame, is separated to create a free end of sliver which is supplying to the roving frame, and then the above-mentioned fresh free end of sliver from the full packaged sliver cans is doubled with the above-mentioned free end of the supplying sliver and component fibers of these free end portions are interlaced mechanically, whereby a unit piecing operation of two slivers is accomplished.

On the other hand, in the modified method of the present invention, in each unit sliver piecing operation a free end of a sliver from a full packaged sliver can is introduced to a position close to a position for carrying out the sliver piecing operation, which position is located on an identical vertical imaginary plane through which a sliver from a sliver can facing the above-mentioned full packaged sliver cans is passing toward the roving frame, and then a free end of the sliver being supplied to the roving frame is created at an upstream position close to the feed rollers, by a separation thereof from a sliver portion from the above-mentioned sliver can, the above-mentioned free end of the sliver from the full packaged sliver can is doubled with the created free end of the above-mentioned sliver, and the doubled portion is then introduced to the feed rollers and the unit sliver piecing operation is completed.

The above-mentioned sliver piecing operation is carried out during a period in which the driving of the roving frame is stopped.

To carry out the above-mentioned method of continuously supplying slivers to a roving frame, the following apparatus is created. Namely, in the apparatus for carrying out the above-mentioned method, it is basically necessary to provide means for arranging a plurality of groups of sliver cans as mentioned above.

Therefore, in this invention, a plurality of conveyer means each comprising a pair of conveyers arranged in parallel along the longitudinal direction of the roving frame are arranged at the sliver-supply position behind the roving frame. In this arrangement of conveyer means, a plurality of groups of sliver cans are arranged on one conveyer of the conveyer means, in an alignment along the longitudinal direction of the roving frame, and further a similar alignment of full packaged sliver cans can be prepared on the other conveyers of any conveyer means.

When the full packaged cans are carried to the standby position on a conveyer of the conveyer means, it is essential to correctly arrange the full packaged cans at the standby position. To this end, means for correctly positioning each of the full packaged sliver cans at a position for a transfer thereof to an entrance end of the conveyer and means for correctly regulating the angular position of a free end of sliver from the full packaged cans with respect to the longitudinal axis of the can, are provided in the apparatus of the present invention.

When the sliver piecing operation is carried out, it is important that it be carried out perfectly. Accordingly, in the basic apparatus of the present invention, the sliver piecing device is provided with two clamps, one of which functions to introduce a free end of a sliver from a full packaged sliver can to a position close to the working position, for carrying out the sliver piecing operation, where a fresh free end of sliver for the sliver piecing operation is created, and another clamp functions to introduce a portion of sliver from the sliver cans, to a position close to the above-mentioned working position, where a free end of sliver which is supplying to the roving frame is created, and further provided with means for doubling these two free end portions of slivers and for interlacing the component fibers forming these two free end portions, to piece the two free end portions of these slivers.

On the other hand, in apparatus having a simplified construction according to the present invention, there is provided a telescopic gripping member which functions to grip the free end portion of a sliver from a full packaged sliver can, prepared at the standby position, and then displace same to a position adjacent to a position for carrying out the sliver piecing operation and located on an imaginary plane through which a sliver from a sliver supplying can on an identical conveyer means passes, and means for forming a free end portion of the sliver which is supplying to the roving frame by separating the other portion of a sliver connected to a sliver from the above-mentioned sliver can, at a position upstream of and close to the feed rollers, and means for doubling the above-mentioned two free ends of slivers for feeding to the feed rollers.

DESCRIPTION OF THE PREFERRED EMBODIMENTS

The construction and function of the method and apparatus for continuously supplying slivers to the respective draft parts of a roving frame, particularly the basic method and apparatus according to the present invention, are first explained in detail with reference to FIG. 1.

Figure 1:
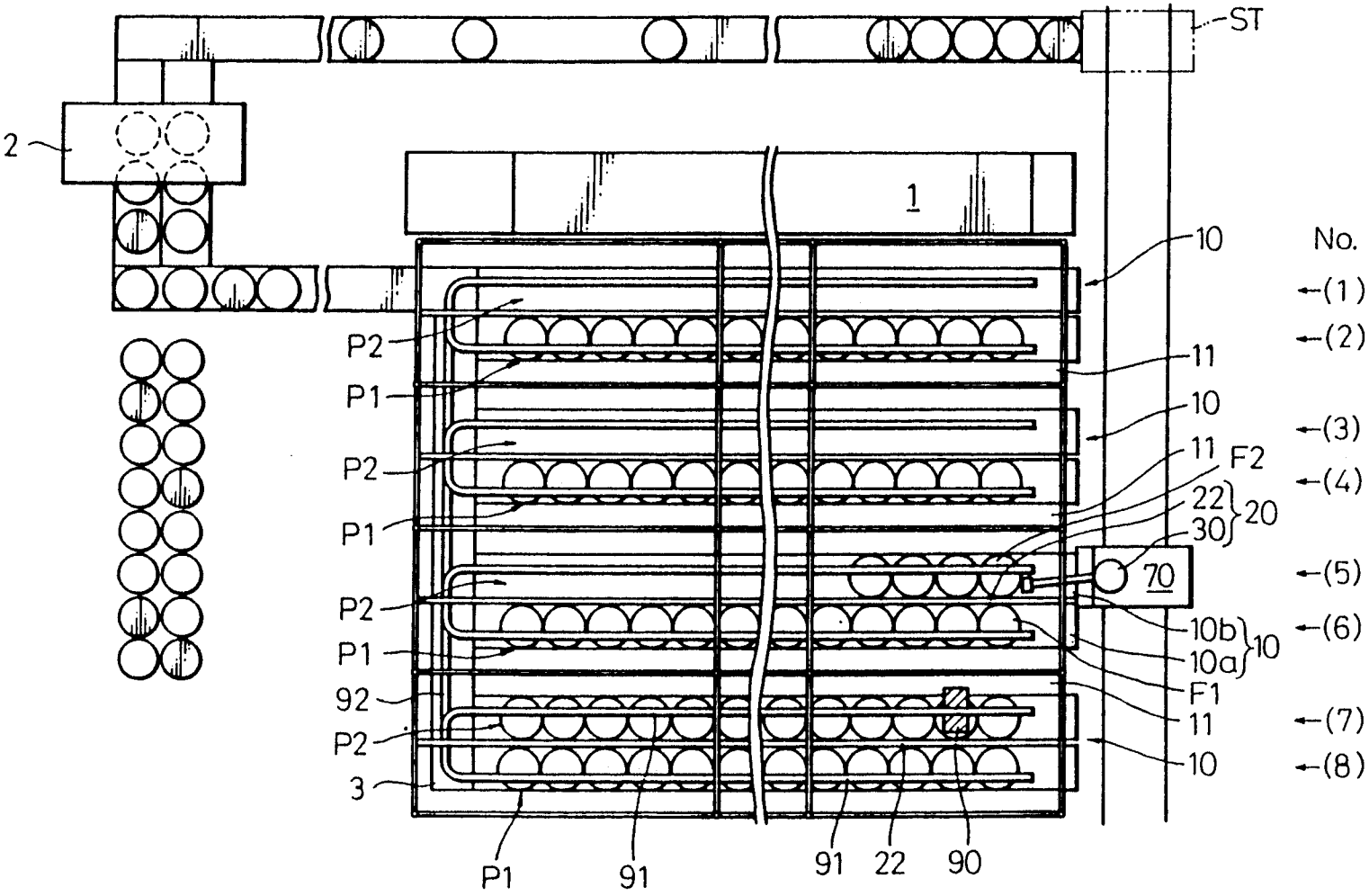
FIG. 1 is a plan view of basic apparatus of the present invention.

As shown in FIG. 1, a number of pairs of conveyers 10a and 10b are arranged at respective positions behind a roving frame 1 along the longitudinal direction of the roving frame 1 in a condition such that an intervening spaced between two adjacent conveyer means 10 is identical, and an intervening space between two conveyers 10a, 10b of each conveyer means 10 is also identical. In a normal operation, before the production by the roving frame is started, sliver cans are mounted on either one of the conveyers 10a, 10b of all of the conveyer means 10, in a condition such that the volume of sliver contained in each sliver can is prepared in a tapered condition with respect to the combination of the conveyer means. That is, for example, when utilizing four conveyer means 10, the volume of sliver of each sliver can mounted on the conveyer 10a of a first conveyer means 10 is full, the volume of sliver of each sliver can mounted on the conveyer 10a of a second conveyer means 10 is ¼ of the full packaged sliver can, the volume of sliver of each sliver can mounted on a conveyer 10a of third conveyer means 10 is ½ of the full packaged sliver can, and the volume of sliver of each sliver can mounted on a conveyer 10a of a fourth conveyer means 10 is ¾ of the full packaged sliver cans. Under such conditions, in each conveyer means 10, the conveyer beside the conveyer on which the sliver cans are mounted is able to freely receive full packaged sliver cans. The position for supporting sliver cans for supplying sliver to the respective draft parts of the roving frame 1 on the conveyer 10a and the conveyer 10b of each conveyer means 10 are hereinafter referred to as P1 and P2, respectively. Each pair of conveyers 10a, 10b is hereinafter referred to as a conveyer means 10. In each pair of conveyers 10a and 10b, a sliver hanger 22 is arranged therealong at a position between and above these conveyers 10a and 10b. Each sliver hanger 22 comprises an endless belt 22b wound around and driven by a pair of horizontal guide rollers 23 (FIG. 2) and a plurality of sliver guides 22a rigidly formed on the endless belt 22b at an identical spacing. A device 20 for positioning a free end of a sliver from a full packaged sliver can F2 comprises the above-mentioned sliver hanger 22 together with a sliver hanging device 30 mounted on a can carrier 70 which is displaceable along the opposite ends of the conveyers 10a and 10b to the ends facing the return conveyer 3. A device for piecing slivers 90 is displaceable along a rail arranged above the cans F1.

The above-mentioned arrangement of the conveyers 10a and 10b is hereinafter explained in more detail. As shown in FIG. 1, four pairs of conveyers 10a and 10b are arranged on a floor, at a position for supplying slivers, behind the roving frame 1, and a narrow passage 11 is provided between each two adjacent pairs of conveyers 10a and 10b, for manual operation. Each conveyer 10a, 10b has a length such that the one-fourth of all of the sliver cans needed for supplying slivers to all drafting parts of the roving frame, can be mounted thereon. In the spinning operation, each sliver can mounted on an identical conveyer 10a contain almost the same quantity of sliver, and the volume of the sliver contained in the sliver cans mounted on the conveyer means 10 is preset in a "taper" arrangement, i.e., the sliver cans mounted on one of the pairs of conveyers 10a, 10b of the conveyer means 10 which is arranged at a position closest to the roving frame 1, are almost full packaged cans, the sliver cans mounted on the pair of conveyers 10a, 10b adjacent to the first-mentioned conveyer means 10 contain almost three-fourths of the full packaged volume, the sliver cans mounted on the pair of conveyers 10a, 10b adjacent to the second-mentioned conveyer means 10 contain one half of the full packaged volume, and the sliver cans mounted on the last pair of conveyers 10a, 10b of the conveyer means 10 which is arranged at a position farthest from the roving frame 1 contain one-quarter of the full packaged volume. In the above-mentioned arrangement, the mounting positions P1 for holding sliver cans F1 containing slivers to be supplied to the roving frame are set on the conveyer 10a (10b), and the mounting positions P2 for holding standby full packaged sliver cans F2 are set at standby positions facing the corresponding sliver cans F1.

Figure 2:
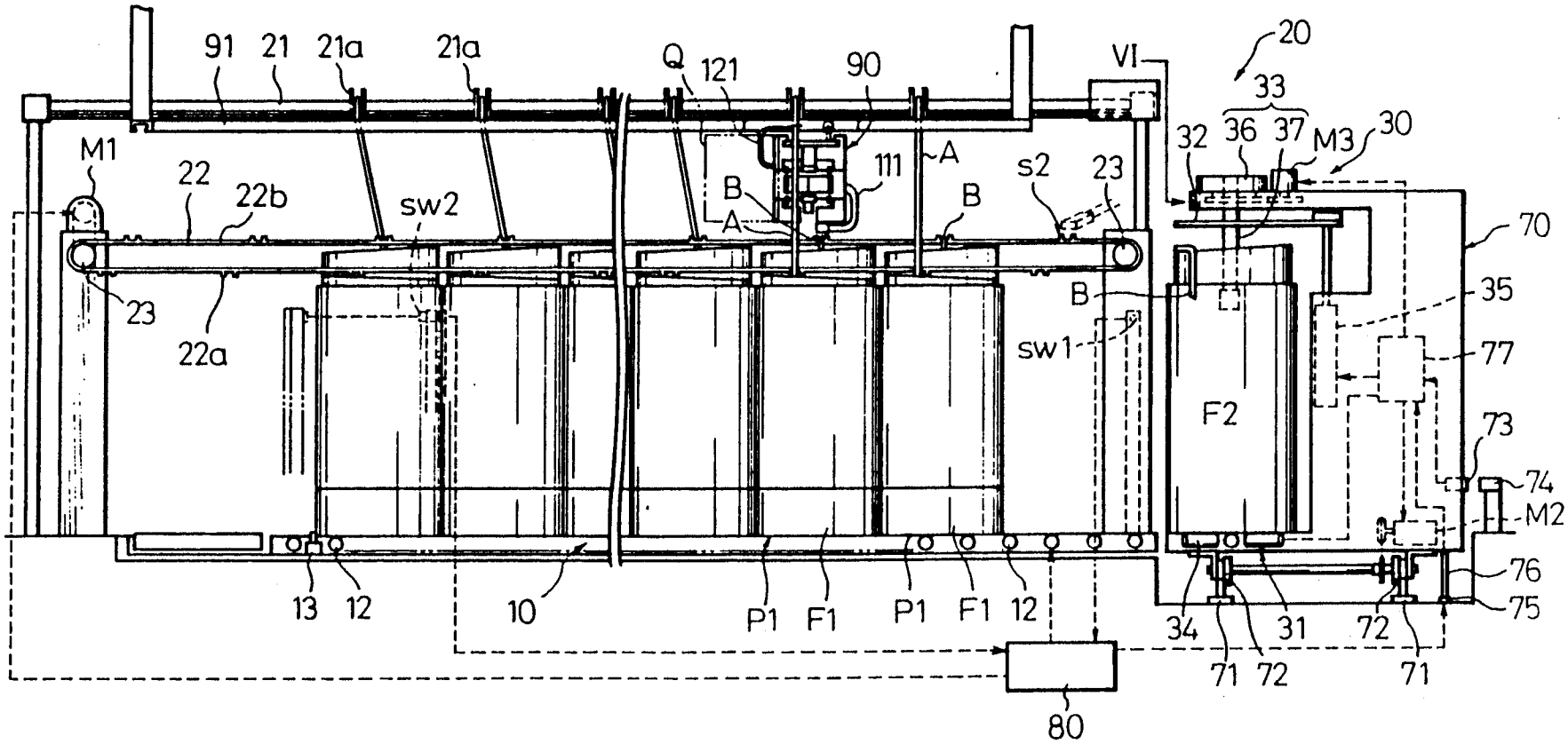
FIG. 2 is a front view of the apparatus shown in FIG. 1.
Figure 5:
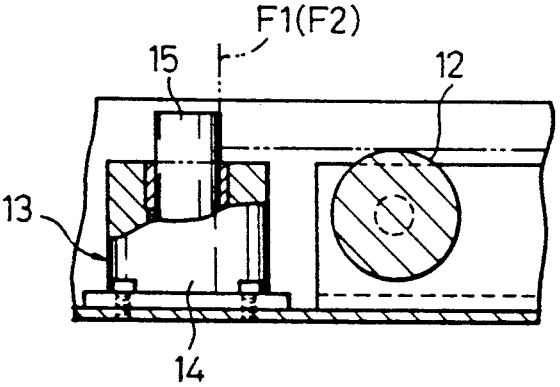
FIG. 5 is a cross section of the positioning device shown in FIG. 3.

Accordingly, when the amount of slivers in the sliver cans F1 reaches an almost exhausted condition, the free end of each sliver from the standby full packaged sliver can F2 is pieced to an end of the sliver A from the corresponding sliver can F1, whereby the full packaged sliver cans F2 cease to be standby full packaged sliver cans F2 and changes its function to a sliver cans F1 supplying slivers to the roving frame, and thus the sliver can standby position P2 becomes the position P1 from which slivers are supplied to the roving frame. As mentioned above, the positions P1 and P2 are changed over each time the functions of the sliver cans held thereon are changed. The conveyers 10a and 10b are roller conveyers provided with a plurality of motor rollers 12. A non-contact limit switch SW1 is disposed at an entrance of these conveyers 10a, 10b, to count the number of full packaged sliver cans passed therebefore. Further, a photo-electric detector SW2 is disposed at a discharge side of these conveyers 10a, 10b to confirm the absence of exhausted sliver cans on these conveyers 10a and 10b, as shown in FIG. 2. A device 13 for regulating the position of the sliver cans is arranged at a discharge side of the conveyers 10a and 10b, i.e., at the side from which the exhausted sliver cans are discharged from the conveyers 10a, 10b, respectively, as shown in FIG. 5. In this device 13, a pin 15 is arranged in such a manner that it is projected upwards from the level on which the sliver cans F1 or full packaged sliver cans F2 are transported, by a cylinder 14, to regulate the position of the sliver cans to predetermined positions by engaging the pin 15 with these sliver cans F1 (F2) when the pin 15 is projected upwards.

Next, the device 20 for regulating the position of sliver ends at a predetermined position is explained with reference to FIG. 2. In FIG. 2, feed rollers 21 of the creel are arranged behind the roving frame, and these feed rollers 21 are located at respective positions above the corresponding pair of conveyers 10*a* and 10*b*. These feed rollers 21 are driven by the drive source of the roving frame, via known gear trains. As already explained, for each conveyer means, a sliver hanger 22 on a belt conveyer system, which is wound rotatably around and supported by a pair of supporting pulleys 23, is arranged at a position below and in parallel with the feed roller 21, and a plurality of holding projections 22*a* are secured on each sliver hanger 22 for catching an end B of a sliver from each of the full packaged sliver cans F2 by a sliver catching device 30, as will be explained later. The pitch between each two adjacent holding projections 22*a* is identical to the distance between the central axis of two sliver cans in contact with each other.

Figure 3:
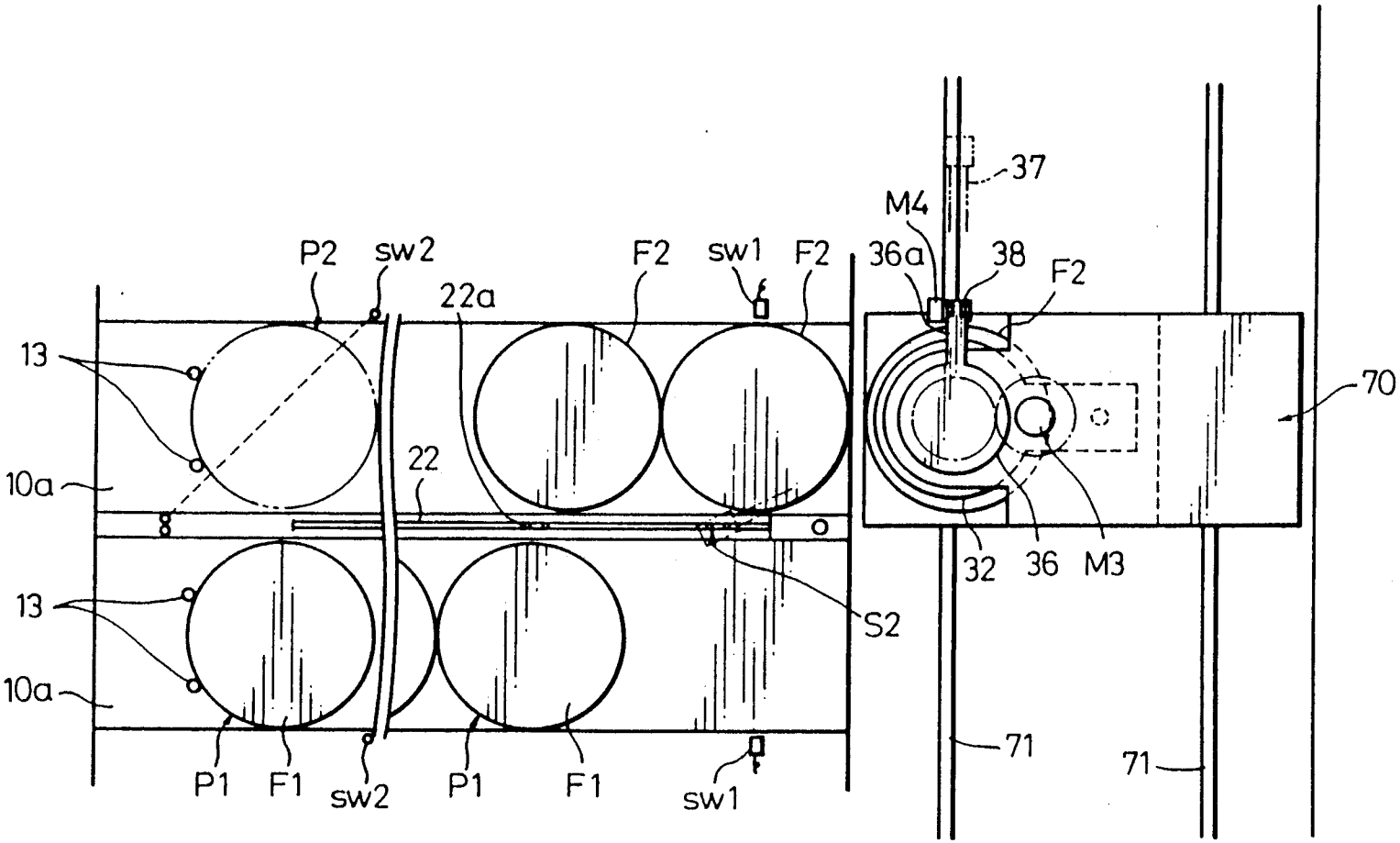
FIG. 3 is a plan view of a device for positioning a free end of a sliver from a full packaged sliver can and used in the apparatus shown in FIG. 1.
Figure 4:
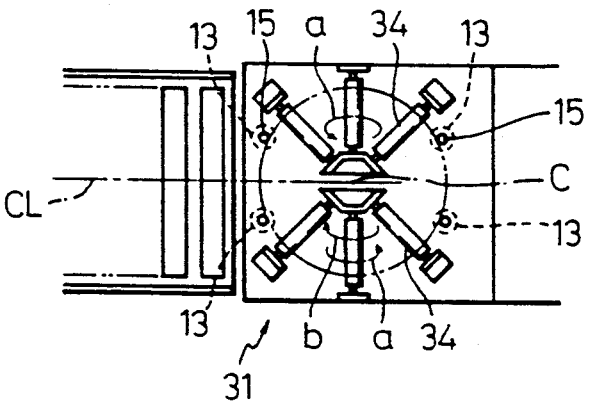
FIG. 4 is a plan view of a device for rotating a full packaged sliver can about longitudinal axis thereof, and utilized in the apparatus shown in FIG. 1.
Figure 6:
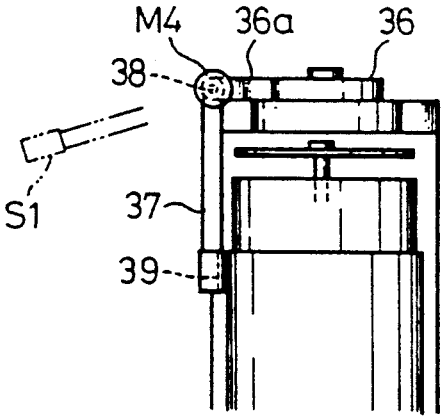
FIG. 6 is a view of the apparatus, taken along the line VI in FIG. 2.

Further, the sliver catching device 30, by which the sliver end B is hung on the sliver hanger 22, is mounted on a full packaged sliver can carrier 70 (hereinafter referred to as can carrier). This sliver catching device 30 comprises a device 31 for turning the sliver cans about the longitudinal axis thereof, a plate 32 for pressing a sliver, and a device 33 for catching a sliver end. The can carrier 70 is provided with a pair of wheels 72 which run along a pair of guide rails 71 arranged at a position such that full packaged cans F2 can be thus supplied to the respective conveyer means. The wheels 72 are driven by a drive motor M2. The above-mentioned can turning device 31 is arranged at a lower portion of the can carrier 70, and is provided with a position regulating device 13 similar to the device shown in FIG. 5. As shown in FIG. 4, six motor rollers 34 of the device 13 are radially and ratably disposed thereon with respect to the turning center C thereof, and these six motor rollers 34 are projected upwards to respective positions at which they come into contact with peripheral portions of the bottom surface of the full packaged sliver cans F2. These motor rollers 34 are divided into two groups with respect to the center line CL in FIG. 4 and the motor rollers 34 of each of these two groups thereof are driven in different, opposite turning directions as shown in FIG. 4, and accordingly, the full packaged sliver can carried onto the device 31 can be turned about the longitudinal axes thereof and displaced to conveyer 10*a* or 10*b* of the corresponding conveyer means 10. The position regulating device 13 is provided with a pin 15, which is projected upward higher than the motor rollers 34, to engage the bottom ends of the full packaged sliver can F2 when the can F2 is turned. Therefore, a possible displacement of the full packaged sliver can F2 from the required holding position is prevented. The sliver pressing plate 32 is arranged at a position above the can turning device 31, in such a manner that it is displaceable upward and downward by a cylinder 35. The sliver pressing plate 32 functions to press downward a portion of sliver overflowing from the upper edge of the full packaged sliver cans F2, so that a desirable condition, in which the sliver end B is always firmly caught by a suction mouth 39, which is hereinafter explained, at an outside surface of the upper edge of the can F2, is obtained. A sliver catching device 33 is disposed at an upper side of the sliver pressing plate 32, and is provided with a turntable 36 mounted on the can carrier 70 to turn coaxially with a turning center of the cans turned by the can turning device 31, and an arm 37 able to be swung upward and downward by a horizontal drive arm 38 secured to a projected portion 38 of the turntable 36, as shown in FIG. 3. The turntable 36 is horizontally turned by a turning motor M3 disposed above the can carrier 70, and the driving shaft 38 is connected to a turning motor M4 secured to the projected portion 36*a*, as shown in FIG. 6, so that the arm 37 can swing between a perpendicular position and a sliver catching position S1 slightly lower than the horizontal level of the position of the motor M4. The sliver suction mouth 39, into which a portion of the sliver from the cans F2 can be sucked, is mounted at a tip end portion of the arm 37 and is connected to an air suction source (not shown).

The can carrier 70 is provided with a position detecting device 73 which is actuated by an indication plate 74, which indicates that a particular conveyer 10*a* or 10*b* of a particular conveyer means needs a supply of full packaged sliver cans F2. The position detecting device 73 and the indication plate 74 are constructed as cooperating elements such as a bar-code detecting device and a indication plate provided with a bar-code thereon. The identification numbers of the conveyers are, for example, (1), (2), (3), . . . (8) from a position at the side of the roving frame. An electric signal transfer rail 75 is arranged outside of the rail 72 on the floor with respect to a position ST in FIG. 1 at which full package sliver cans F2, carried from a prior process, are mounted on the can carrier 70 to a position facing the end of the conveyer 10*b* of the last conveyer means arranged at a position farthest from the roving frame. A shoe 76, by which an signal can be received, is disposed below the carrier 70 and in slidable contact with the electric signal transfer rail 75. The operations of the above-mentioned can turning device 31, sliver catching device 33, sliver pressing plate 32, and the motor M2 are controlled by a control device 77 mounted on the can carrier 70. The control device 77 functions to stop the driving of the motor M2, when an electric signal, which indicates a number of a particular conveyer to which the supply of full packaged sliver cans must be made, received from the shoe 76 coincides with a specified identification number issued by the device 73.

Next, a main control device 80, which ouptputs an actuation signal to the signal transfer rail 75, is explained in detail.

The main control device is provided with a program controller having a following function. That is an identification signal indicating a number of sliver cans, a signal confirming whether sliver cans are mounted on either one of the conveyers 10*a*, 10*b* of each pair of conveyers 10*a*, 10*b*, are input thereto. The main controller 80 is also provided with a function such that, when full packaged sliver cans are mounted on the respective supply positions of either one of the conveyers of either conveyer means 10, it counts a lapse of time from a time of starting the feeding of sliver from the full packaged sliver cans, so thus automatically calculating the volume of sliver remained in the sliver cans. Therefore, the volume of sliver of all sliver cans mounted on any identical conveyer 10*a* or (10*b*) can be continuously measured, because the volume of slivers contained in all sliver cans mounted on identical conveyers 10*a* (10*b*) is almost identical. However, at the time of starting the production of the roving frame, since a taper arrangement of sliver cans with respect to the volume of sliver contained in the sliver cans is applied, as already explained, it is necessary to adjust the counting means to count a lapse of time that will coincide with the above-mentioned taper arrangement of the sliver cans. The main control device 80 is provided with a further function based upon the above-mentioned counting function, i.e., when it is detected that the volume of sliver of sliver cans 10*a* (10*b*) of any conveyer means 10 reaches a volume such that it is a little less than one quarter of the full packaged sliver cans, it is determined that whether or not the other conveyer 10*b* (10*a*) of identical conveyer means 10 is supporting sliver cans, and if it is confirmed that this conveyer 10*b* (10*a*) free to receive sliver cans, the main control device issues an actuation signal to this conveyer means and the electric signal transfer rail 75, to supply the full packaged sliver cans thereto. As mentioned above, the full packaged sliver cans F2 are then supplied to the above-mentioned conveyer, and when the operation of supplying a predetermined number of full packaged sliver cans F2 to the conveyer is completed, a signal for stopping the supply of full packaged sliver cans F2 to this conveyer is output by the main control device 80. The main control device 80 further controls the driving of the conveyer means (conveyers 10*a*, and 10*b*), a drive motor M1, and the operation of the sliver end position regulating device 20. Namely, when the predetermined number of full packaged sliver cans F2 are positioned at the above-mentioned standby positions P2 on the conveyer 10*a* (10*b*) respectively, the angular positions of the ends of each of the slivers from the respective full packaged sliver cans F2 are controlled so as to be at the respective predetermined angular positions as shown in FIG. 2, and when the above-mentioned sliver ends B are hung over the corresponding sliver hangers 22 by the sliver catching device 30, the position of each catching projection 22*a* at the sliver hanging position S2 is controlled as shown in FIG. 3.

Next, the device for piecing a sliver 90 is explained in detail with reference to FIG. 2.

Figure 7:
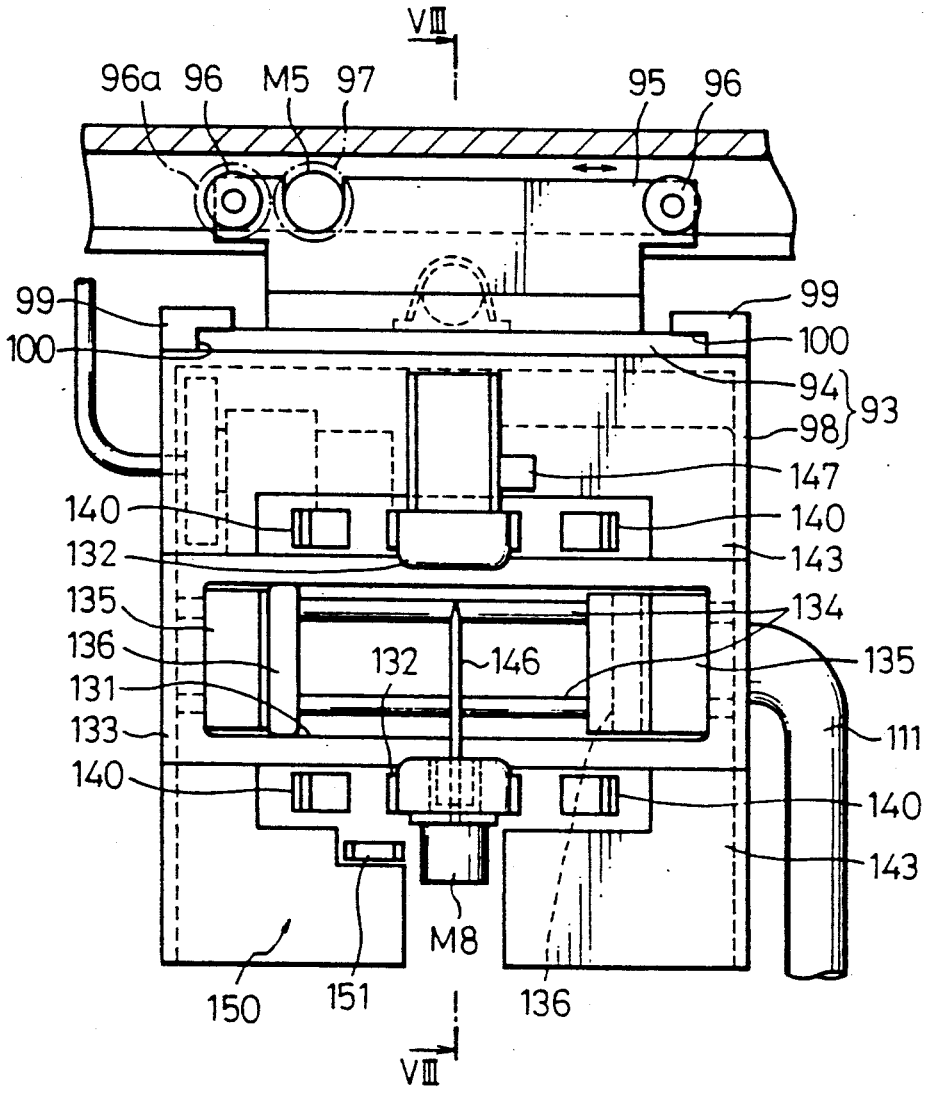
FIG. 7 is a front view of a device for piecing slivers and applied to the apparatus shown in FIG. 1.
Figure 8:
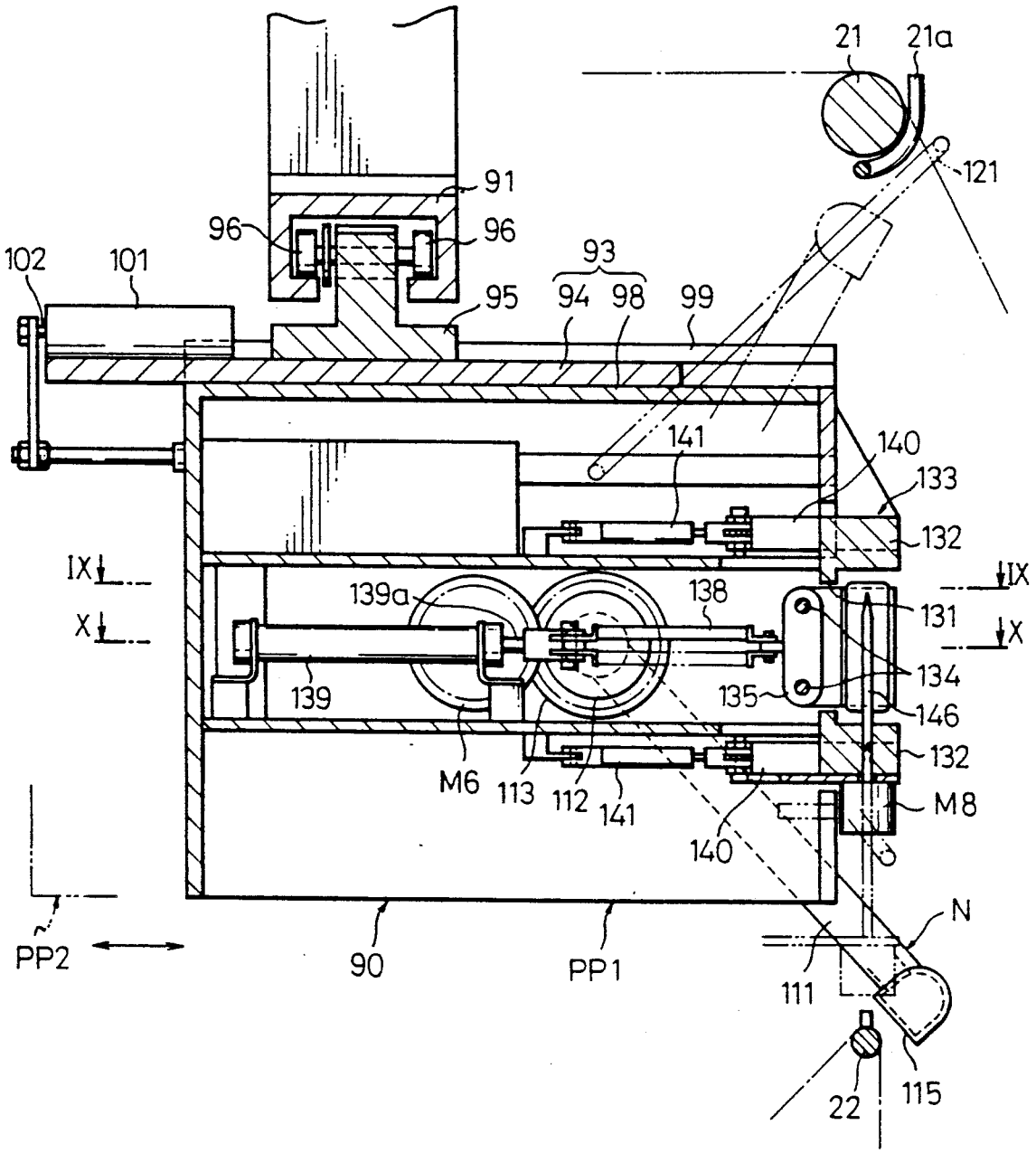
FIG. 8 is a cross sectional view of the device shown in FIG. 7, taken along the line VIII—VIII.

As shown in FIG. 2, the sliver piecing device 90 is displaceably mounted on a horizontal guide rail 91 suspended from a ceiling of a building where the roving frames are installed, at a position slightly below the corresponding feed rollers 21 but above the corresponding conveyer means (conveyers 10*a*, 10*b*). The above-mentioned guide rail 91, as shown in FIG. 1, is connected to a main guide rail 92 arranged above the return conveyer 3, and returns exhausted sliver cans to the prior process, arranged at the discharge side of the conveyer means, by a switching device (not shown). The guide rail 91 is provided with a particular cross section shape as shown in FIG. 8. A bracket 95 is secured to a base 94 of a main body 93 of the device 90, and two pairs of running wheels 96 are rotatably secured to corresponding horizontal shafts rotatably mounted at the upper projected portion of the bracket 95, so that these wheels 96 are able to run on the corresponding guide rail portions formed inside the guide rail 91 respectively, and accordingly, the device 90 is displaceably suspended by the guide rail 91. One pair of the running wheels 96 is driven by a drive motor M5 through a gear train composed of gears 96 and 97, as shown in FIG. 7, so that the device 90 is displaceable along the longitudinal direction of the sliver hanger 22. Both ends, with respect to the longitudinal direction of the sliver hanger 22, of the base 94 are slidably engaged in corresponding guide grooves 100 formed in the upper side portions of slide bodies 99 secured to both sides, with respect to the above-mentioned direction, of a body 98 of the main body 93. A fluid cylinder 101 is mounted on the base 94 so that the sliver piecing device 90 is displaceable from a sliver piecing position PP1 (FIG. 8) located between the feed roller 21 and the sliver hanger 22 to a standby position PP2 located below the creel, from where the entire body of the sliver piecing device 90 is displaceable along a direction perpendicular to the longitudinal direction of the conveyers 10*a*, 10*b*, without interferring with the slivers being supplied to the roving frame, and vice versa. The above-mentioned position PP2 is indicated by a two-dot line in FIG. 8.

Figure 9:
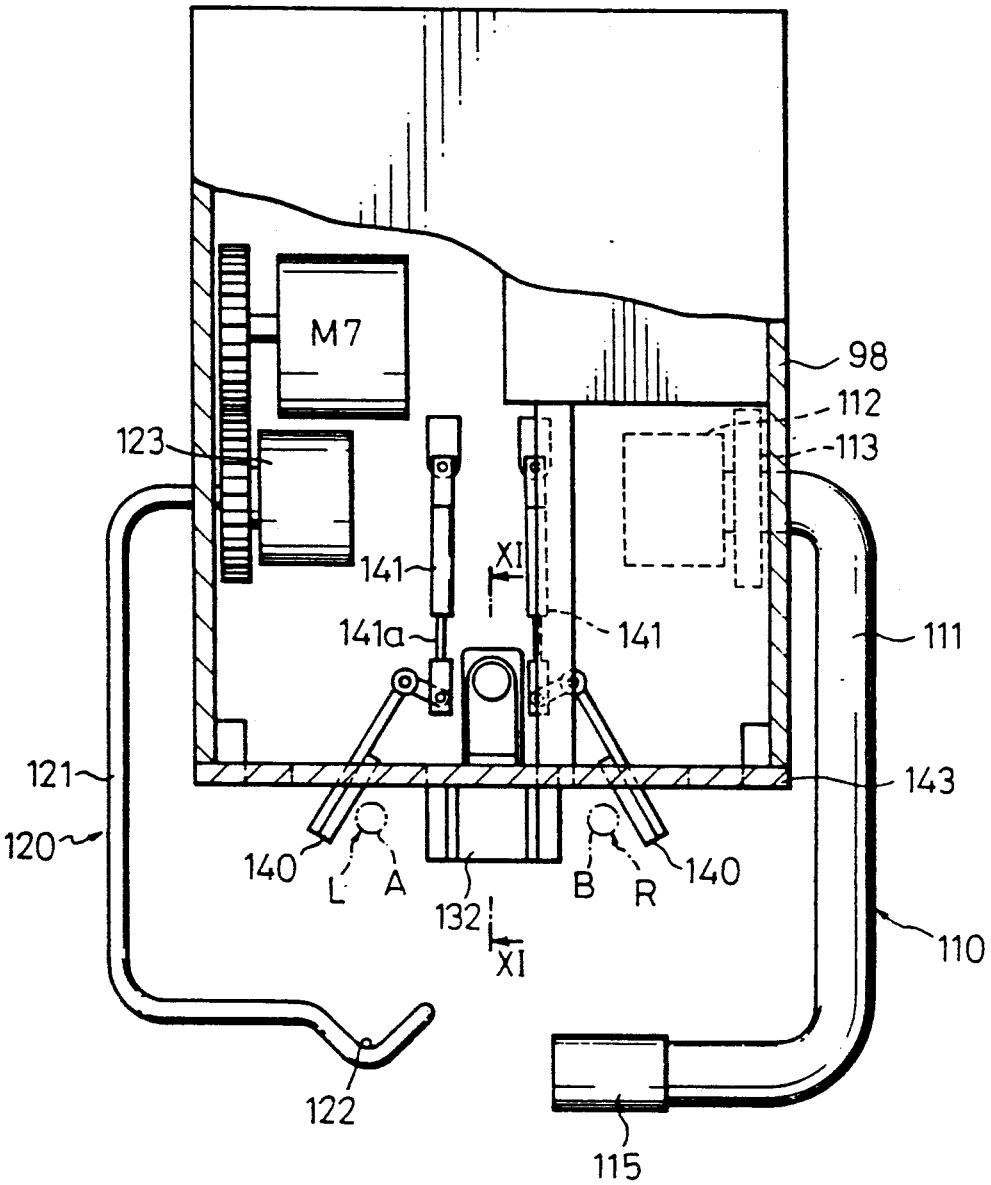
FIG. 9 is a cross sectional view of the device shown in FIG. 8, taken along the line IX—IX.
Figure 10:
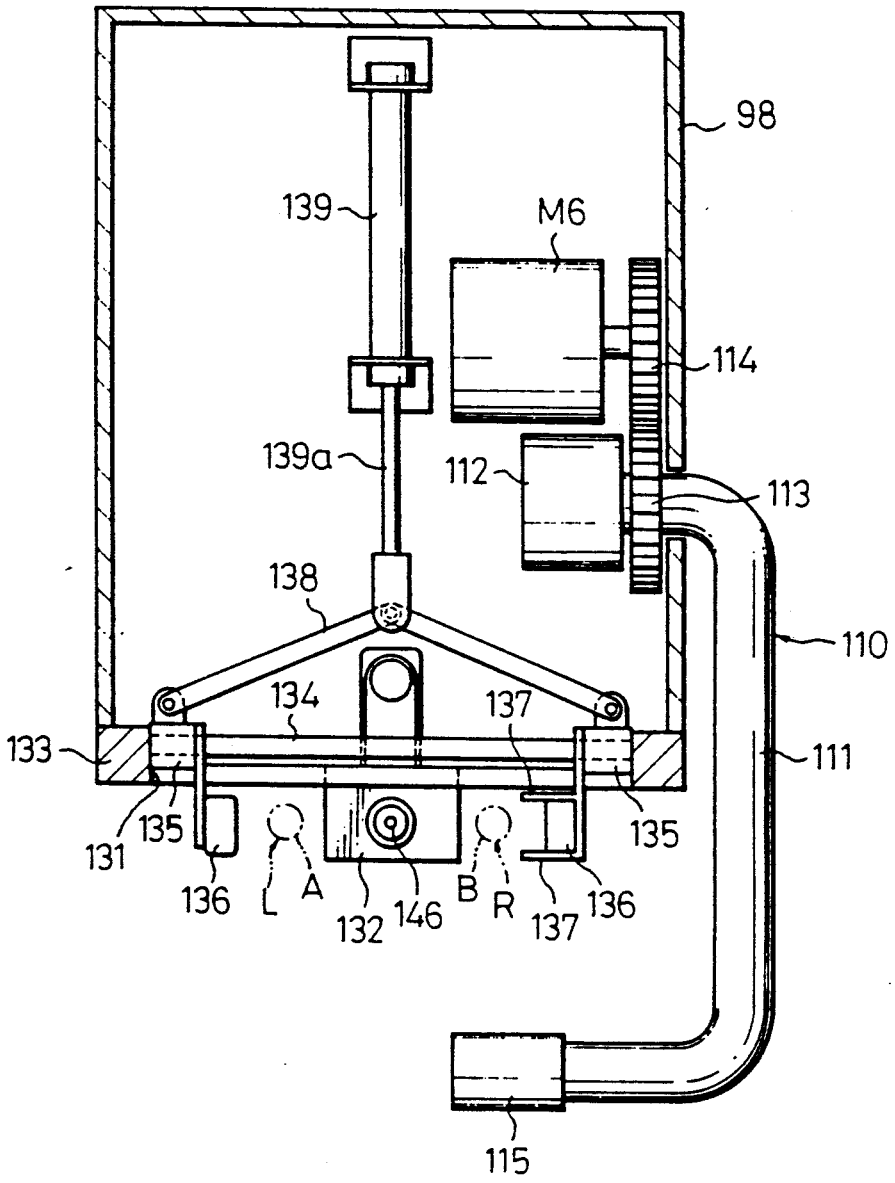
FIG. 10 is a cross sectional view of the device shown in FIG. 8, taken along the line X—X.

In a first catching device 110 mounted on the body 98, as shown in FIG. 10, a suction arm 111 is mounted on a right hand side of the body 98 and able to be swung upward and downward through a bearing 112. The suction arm 111 is provided with a gear 113 secured to the base thereof and meshing with a gear 114 of a motor M6. A suction mouth 115 is provided at the tip of the suction arm 111 and faces the sliver hanger 22 when the suction mouth 115 is positioned at the standby position thereof indicated by a solid line in FIG. 8. The suction mouth 115 is connected to a suction air source located inside the body 98. Further, in a second catching device 120, as shown in FIG. 9, a catching hook 121, formed from a rod, is supported such that it is able to be swung upward and downward through a bearing 123. This catching hook 121 and the above-mentioned catching arm 111 are driven by a motor M7. The catching hook 121 has a recess formed therein to lead the sliver A, supplied to the roving frame, and extending between the sliver supply can and the feed roller 21, to a guide portion 122 of the second catching device 120 by catching the sliver A therein, to introduce the sliver A to a predetermined position (a left-hand side position L in FIG. 9), against the sliver end B of the corresponding sliver B from the corresponding full packaged sliver cans.

Next, the construction and function of the sliver piecing device 130 is explained in detail. As shown in FIG. 7. in the sliver piecing device 130, a sliver piecing plate 133 is secured to to the front surface of the body 98 and a rectangular opening 131 is formed in the plate 133, and a pair of sliver catching projections 132 are projected toward the above-mentioned rectangular opening 131. The sliver piecing plate 133 is provided with two rods 134 at respective positions inside the rectangular opening 131, and a pair of sliders 135 are slidably mounted on the rods 134. A rubber element 136, which works as a sliver catching member, is mounted on the forwardly projected portion of the rectangular opening 131. This rubber element 136 functions to resist a possible rotation of the sliver about the axis thereof when the rubber element 136 comes into contact with the outside surface of the sliver, as shown in FIG. 10. A pair of holding plates 137 are arranged at respective positions at the front of and back of the rubber element 136.

Figure 11:
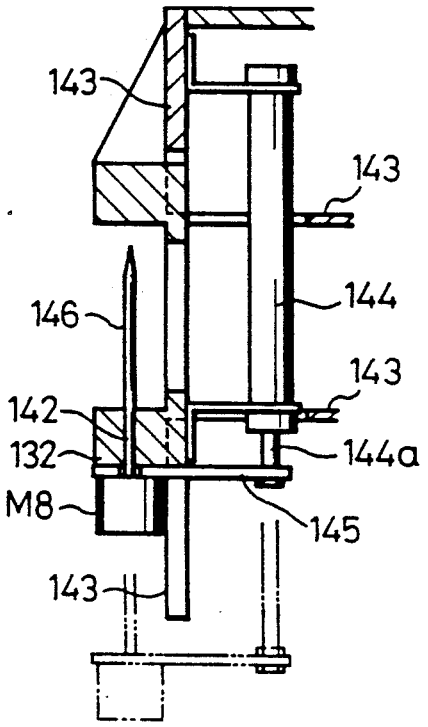
FIG. 11 is a cross sectional view of the device shown in FIG. 9, taken along the line XI—XI.

These sliders 135 are connected to a piston rod 139*a* of a cylinder 139 by a pin through a link mechanism 138, so that these sliders 135 are capable of approaching or separating from each other by the forward and rearward motion of the piston rod 139*a*. A pair of clampers 140 are arranged at both sides of the sliver catching projection 132, to hold slivers at each side, respectively, of the projection 132, as shown in FIG. 9, and these clampers 140 are connected to respective piston rods 141*a* of corresponding cylinders 141. As shown in FIG. 11, a guide aperture 142 is formed in the projection 132. Further, a piston cylinder 144 is held by upper and lower plates 143 secured to a front surface of the body 98, a connecting plate 145 is rigidly held in horizontal condition by a piston rod 144*a* of the cylinder 144, and a drive motor M8 is rigidly mounted on the connecting plate 145 such that a shaft 146 of the motor M8 is slidably and rotatably inserted in the guide aperture 142. The shaft 146 of the motor M8 is provided with a sharpened tip end having a satin finish so that a surface having high coefficient of friction is provided on the tip end of the shaft 146.

A nipper device 151, which is a member of a sliver separating device 150, is arranged at a position below and cooperates with the corresponding clampers 140.

Figure 12:
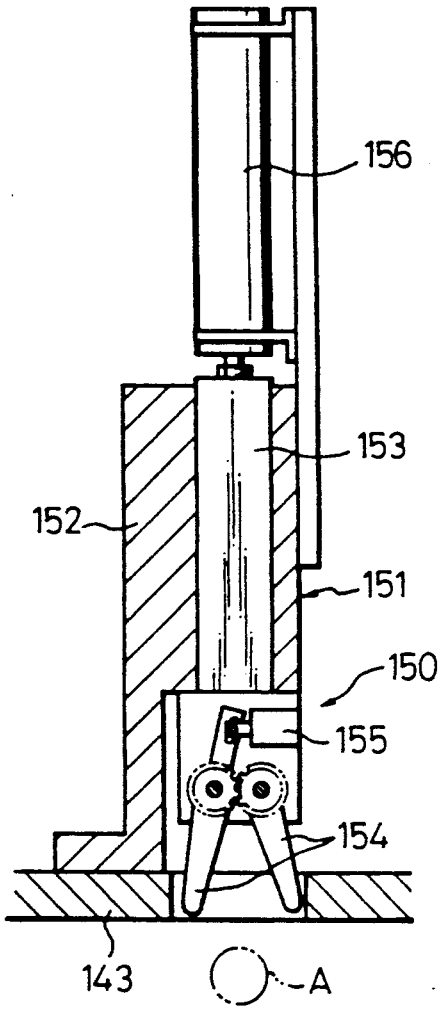
FIG. 12 is a cross sectional view of a cutting device utilized for the device shown in FIG. 1.

As shown in FIG. 12, a sliding arm 153, as a member of the nipper device 151, is mounted on a bracket 152 secured to the plate 143 such that sliding arm 153 can slide upward and downward. A pair of grippers 154 are rigidly mounted on corresponding shafts horizontally and rotatably mounted on a free end of the arm 153 such that a pair of gears mounted on the respective horizontal shafts are meshed with each other. An actuation cylinder 155 is rigidly mounted on the arm 153 such that an end of one of the grippers 154 is turnably connected with an end of a piston rod of the actuation cylinder 155, whereby the grippers 154 can be closed to grip a sliver by actuating the cylinder 155. The rear end of the sliding arm 153 is connected to a piston rod of a cylinder 156 rigidly mounted on the main body of the device 150, so that the sliding arm 153 can be displaced downward. Accordingly, the supply sliver A is caught by the gripper 154 while held by the clamper 140 when the nipper device 151 is displaced downward, and in this condition, the nipper device 151 is further displaced downward and the sliver is separated into two portions at a position between the clamper 140 and the nipper device 151. As shown in FIG. 8, a suction mouth 147 is arranged at the clamper 140 to suck in the tip of the free end of the sliver, and this suction mouth 147 is connected to a suction device mounted to the body 98.

Next the functions of these elements in the exchanging operation of the sliver cans F1 by the full packaged sliver can is hereinafter explained in detail with reference to FIGS. 1 and 2.

The function of the sliver position regulating device is first explained. Namely, it is assumed that, in the embodiment shown in FIG. 1 wherein four conveyer means 10 are utilized, sliver cans F1 are mounted on the respective supply positions P1 of each conveyer represented by the identification number (2), (4), (6), and (8), respectively. The volume of sliver contained in the respective sliver cans mounted on these conveyers 10*a* (10*b*) is prefixed in a "taper" arrangement, and when the volume contained in the sliver cans on the conveyer (2), (4), (6), and (8) approaches ¾, 2/4, ¼, and 0 of the volume of the full packaged sliver cans F2, the sliver cans on the conveyer (8) are replaced by full packages sliver cans F2 already mounted at each supply position on, the conveyer 7. The volumes of sliver contained in the sliver cans, which changes in accordance with the consumption of the sliver, are continuously stored in a memory of the control device. Since it has been determined by the control device that the conveyer 6 needs a supply of full packaged sliver cans F2, when the completion of the operation of discharging the exhausted sliver cans on the conveyer 6 is detected by the photoelectric detecting device SW2, the main control device 80 outputs an actuating signal together with a direction signal for displacing the cans carrier 70, which is waiting at the standby position ST after picking up full packaged sliver cans F2 supplied from the drawing process, to the conveyer 5, via the signal transportation rail 75 and the shoes 76. When the above signals are output, the cans carrier 70 is displaced to the conveyer 5 and stopped at a position at which the full packaged sliver cans F2 can be supplied to the conveyer 5 after confirmation of the position of the carrier 70 by the conveyer number identification plate 74. During the above displacing motion of the cans carrier 70, a free end B of the sliver contained in the full packaged sliver cans F2 is caught. The above catching of the free end B of the sliver is carried out as follows, i.e., in each conveyer means 10, when carrying out the catching operation at the full packaged sliver cans F2 which are mounted on a conveyer arranged at the side of the roving frame 1, the arm 37 of the sliver end catching device 33 is positioned at a left-side catching portion in FIG. 6. When carrying out the catching operation at full packaged sliver cans F2 mounted on another conveyer of the identical conveyer means 10, the arm 37 of the sliver end catching device 33 is positioned at a right-side catching position in FIG. 6, by turning the rotation disk 36, respectively. The sliver pressing plate 32 is then displaced downward to press against the sliver, and the free end B of the sliver contained in the full packaged sliver can F2 is positioned just below the upper edge of the can-body 93. Therefore, the can turning device 31 is driven and the motor rollers (six) 34 of the device 31 are rotated in the same direction (direction indicated by "a" in FIG. 4) so that the full packaged sliver cans F2 are rotated about their longitudinal axes. At this time, the pin 15 of the position deciding device 13 is projected, and the full packaged cans F2 are thus turned about their longitudinal axes without being separated from the motor rollers 34 while the bottom edges thereof by are guided the projected pin 15. When the free end B of the sliver is sucked by the suction mouth 39 of the arm 37 during the above turning motion of the cans F2, the turning motion of the cans F2 is stopped, so that the angular position of the free end B of the sliver is regulated and the sliver pressing plate 32 is then displaced upward, i.e., the arm 37 swings upward to the position indicated by S1. When the sliver catching operation is carried out as mentioned above, three motor rollers 34 located in respective positions above the center line CL in FIG. 4 are rotated in the direction "a", and the other three motor rollers 34 located in respective positions below the center line CL in FIG. 4 are rotated in the direction "b", whereby the full packaged cans F2 are supplied to the conveyer 5, while the free end B of the sliver is caught by the arm 37. The motor rollers 12 of the conveyer 5 are then driven to run the conveyer 5 for one pitch, which is almost identical to a diameter of the sliver cans, of the arrangement of the sliver cans thereon, and accordingly the full packaged sliver can F2 is positioned at the entrance of the conveyer 5.

At this stage, the holding projection 22*a* of the sliver hanger 22, which is not holding sliver, is moved to a position S2 shown in FIG. 3, and when the full packaged sliver can F2 is supplied onto the conveyer 5, the arm 37 is turned by the rotation of the disc 36 so that the free end B of the sliver, which is caught by the suction mouth 39 of the arm 37, is positioned vertically above the above-mentioned holding projection 22a at the position S2. Then the suction by the suction mouth 39 is stopped, and the sliver end B is hung on the holding projection 22a at the regulated angular position. The above-mentioned operation of supplying full packaged sliver can F2 to the conveyer 5 while hanging the sliver end B on the corresponding holding projection 22a is repeated, and each time the above-mentioned operation is completed, the limit switch SW1 output a count signal to count the number of full packaged sliver cans F2 supplied to the conveyer 5. When it is confirmed that a predetermined number of full packaged cans F2 (in this embodiment, one-fourth of the number of spindles of the roving frame 1) has been supplied to the conveyer 5, by counting the number of completions of the above-mentioned operation, the supply of the full packaged sliver cans F2 to the conveyer 5 is stopped. Then the pin 15 of the position deciding device 13 arranged at the discharging side of the conveyer 5 is projected and the motor rollers 12 of the conveyer 5 are driven until the full packaged sliver can F2 first supplied to the conveyer 5 comes into contact with the pin 15, whereby the full packaged sliver cans F2 are positioned at their respective standby positions P2. The sliver hanger 22 is synchronously driven to displace the holding projections 22a while they face the corresponding full packaged sliver cans F2, and therefore, each sliver end B of the full packaged sliver cans F2 caught by the suction mouth 39 of the arm 37 is also displaced towards the discharge side of the conveyer 5, while hanging on the corresponding holding projection 22a. The above-mentioned operation of supplying full packaged sliver cans F2 is carried out during the operation of the roving frame 1. The condition of the conveyer means 10, wherein sliver cans F1 are mounted on the conveyer 7, and full packaged sliver cans F2 are mounted on another conveyer 8, is shown in FIG. 1.

Figure 14:
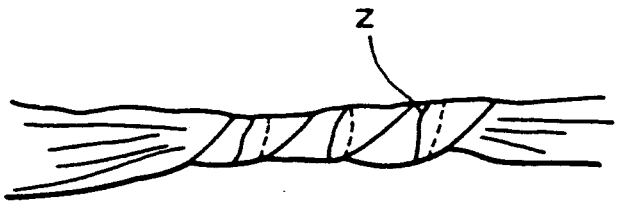
FIG. 14 is an explanatory view of the piecing condition of the slivers.
Figure 14:
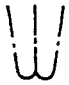
Figure 13A:
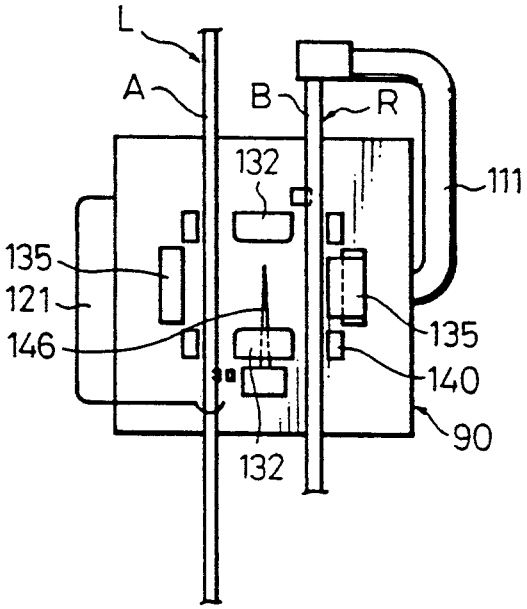
FIGS. 13A, 13B, 13C and 13D are explanatory views of the sliver piecing operation according to the present invention.
Figure 13B:
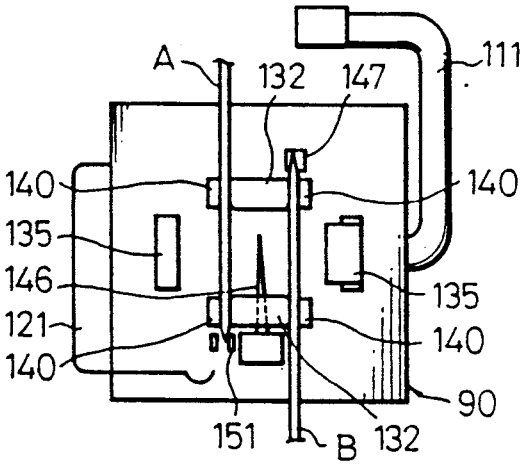
Figure 13C:
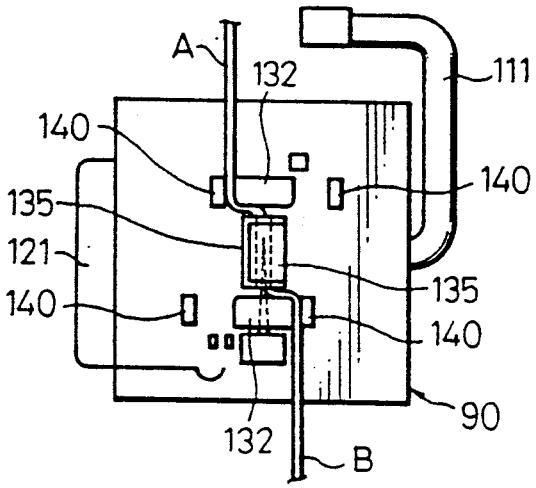
Figure 13D:
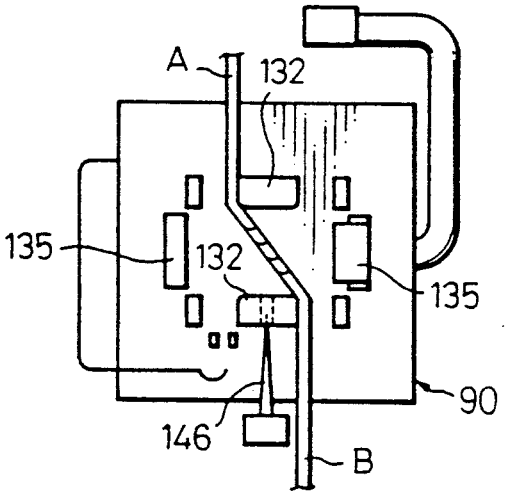

Next, the piecing operation of the sliver from the sliver cans F1 on the conveyer 7 and the sliver from the full packaged sliver cans F2 facing the above-mentioned sliver cans F1 on the conveyer 8 is explained in detail. The sliver piecing operation is carried out in parallel when the operation of the roving frame 1 is stopped, for example, at the time of doffing full packaged roving bobbins produced by the roving frame 1. The sliver piecing device 90 is displaceable along the longitudinal direction of the roving frame 1 while being displaced rearward to the position PP2 (FIG. 8). When this is necessary to carry out the piecing operation, the sliver piecing device 90 is displaced along the conveyer in such a manner that the catching hook 121 thereof does not interface with the slivers A which are supplying to the roving frame 1, and at a level above the arrangement of full packaged sliver cans F2, from the standby position PP2 thereof to the position PP1 (FIG. 8) for carrying out the sliver piecing operation. Then the suction arm 111 is slightly displaced to a position facing the sliver end B of the full packaged sliver can F2, which was located at a predetermined standby position, along the conveyer means 10 as shown in FIG. 2. In this condition, the catching hook 121 is located at a position above the standby position, and the suction arm 111 is located at a position below the standby position. Next the catching hook 121 is displaced downward so that the sliver A, which is supplying to the roving frame, is caught and brought to a position L in FIG. 13A at the left side of the shaft 146. The suction arm 111 is synchronously actuated to suck the sliver end B of the full packaged sliver can F2 is then swung upward. As mentioned above, since the supplied sliver A and sliver end B are simultaneously caught, the time required for catching these slivers is shortened. According to the above-mentioned operation, the sliver end B of the full packaged sliver can F2 is positioned at a position R in FIG. 13A at the right side of the shaft 146. Then the four clampers 140 are actuated, so that the sliver A and the sliver end B are held between the respective clampers 140 and the corresponding projections 132. In this condition, the nipper body 151 is displaced forward while the grippers 154 are opened, and after gripping the sliver A, the grippers 154 are closed and the nipper body 151 is further displaced forward. Accordingly, the sliver A is separated into two portions at a position between the clamper 140 located below and the nipper body 151 into a sliver portion supplying to the roving frame 1 and a remaining sliver portion from the sliver F1. The remaining sliver portion held by the nipper body 151 is carried to a position above the sliver can F1 by the forward displacement of the nipper body 151, and is dropped into the sliver can F1 by opening the grippers 154 at this position above the cans F1. Further, the sliver end B is sucked by the suction mouth 147, to cut the sliver, and the excess portion thereof extended from the clamper of right side 140 is sucked into the suction mouth 145 as shown in FIG. 13B. Then, a pair of sliders 135 positioned at both sides of the shaft 146 are displaced toward and approach the shaft 146. When the sliver end B is introduced into a recessed portion of the sliver holding plate 137 secured to the slider 135 (right side in FIG. 10), the clamper 140 arranged at the upper right side (FIG. 13A) and the clamper 140 arranged at the lower left side (FIG. 13A) are moved so that contact thereof with the corresponding projected portions 132, respectively, is lost. Thereafter, the sliders 135 are successively brought closer to each other so that a free end of the sliver supplying to the roving frame 1 and B are gently pressed against the shaft 146 in such a manner that the peripheral portions of these sliver ends are frictionally held by the rubber element 136, as shown in FIG. 13C. At this stage, the shaft 146 is driven, and to such action of the elements of the sliver piecing device 90, since the peripheral surface of the rotation shaft 146 has a satin finish, the high coefficient of friction of the satin finish of the peripheral surface of the shaft 146, causes these free ends of slivers which are doubled in the supplying condition to the roving frame 1 to be twisted together by the frictional rotation of the shaft 146 in such a manner that the fiber layers of the doubled free ends of slivers, are forced to turn about the longitudinal axis thereof by the rotation of the shaft 146. This twisting motion of these doubled ends of slivers causes this doubled portion to be pieced together in a condition such that the component fibers, thereof are interlaced by the twisting motion of these two free end portions of slivers, so the two slivers are pieced. After the above-mentioned operation of the shaft 146, the shaft 146 is separated from the pieced portion so that a unit sliver piecing operation is completed. The appearance of a typical pieced portion of these slivers is shown in FIG. 14. As is easily understood from FIG. 14, a squeezed portion Z is created by the above-mentioned sliver piecing operation, and this portion Z prevents an easy separation of the joined sliver ends, and therefore, the portion Z is very useful when carrying out the operation of the roving process. Thereafter, the shaft 146 is moved downward and separated from the pieced portion Z, and the sliver piecing operation is completed. When the sliver piecing operation is completed, the clampers 140 and sliders 135 are all returned to their respective standby positions (FIG. 13D). Also, the body 98 of the sliver piecing device 90 is returned to the standby position PP2, and then the device 90 is displaced to along the conveyer to the next position at which the sliver piecing operation is to be carried out. During this displacement of the device 90, the sliver catching hook 121 and the suction arm 111 are also returned to their respective standby positions. The sliver piecing operation is repeated at all of the full packaged sliver cans on the identical conveyer. Thereafter, the sliver piecing device 90 is displaced to another conveyer by utilizing a switching device (not shown).

In the above embodiment, the sliver end B from the full packaged sliver cans is hung on the sliver hanger 22 and is then caught by the suction arm 111, but the following modification of this operation can be applied. Namely, instead of hanging the sliver end B of the full packaged sliver cans F2 on the respective projected portions 22*a* of the sliver hanger 22, the sliver end B is positioned at a predetermined angular position on the full packaged sliver cans F2 and this sliver end B is then caught directly by the suction arm 111.

Next the construction and function of a further modification of the above first embodiment of the present invention is explained in detail.

Figure 15:
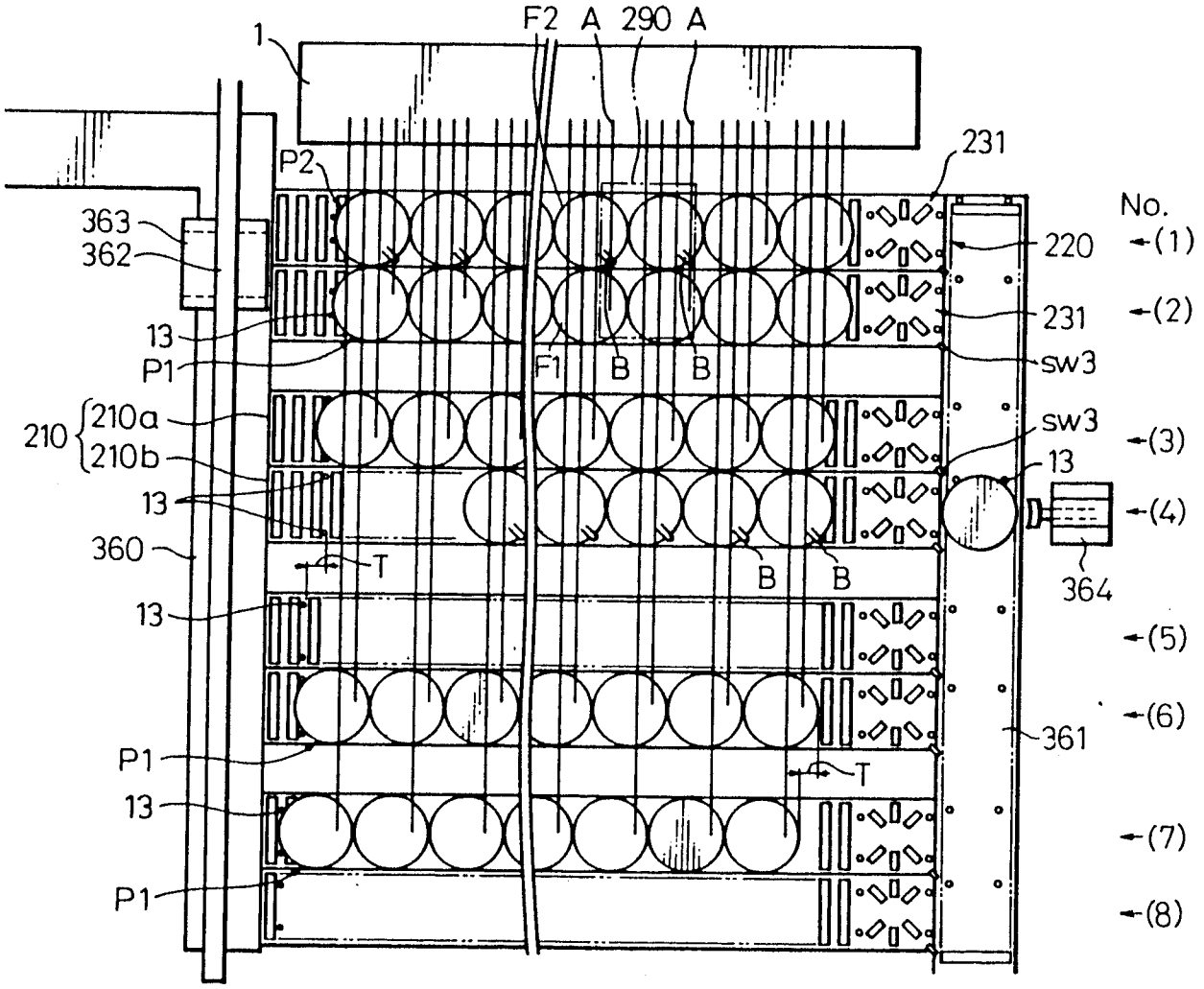
FIG. 15 is a plan view of the second embodiment of the present invention, showing the entire body of the apparatus.

As shown in FIG. 15, the first modification is applied to the conveyer means; i.e., the arrangement of the cans positioning device 13 with respect to the conveyer means 10 is different from that of the first embodiment shown in FIG. 1. As shown in FIG. 15, the device 13 is designed to take respective positions at the corresponding conveyer means while slightly biased therefrom with respect to the arrangement of the conveyer means 10. Accordingly, although the arrangement of the sliver cans on the two conveyers 210*a* and 210*b* of the conveyer means 210 is the same, the axial position of each of the sliver cans on the conveyers of a different conveyer means is stepwisely changed with respect to the arrangement of the conveyer means 210, by a bias distance T as shown in FIG. 15.

Figure 16:
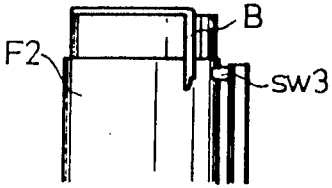
FIG. 16 is an explanatory view of a device for finding a sliver from a full packaged sliver cans, applied to the second embodiment shown in FIG. 15.
Figure 17:
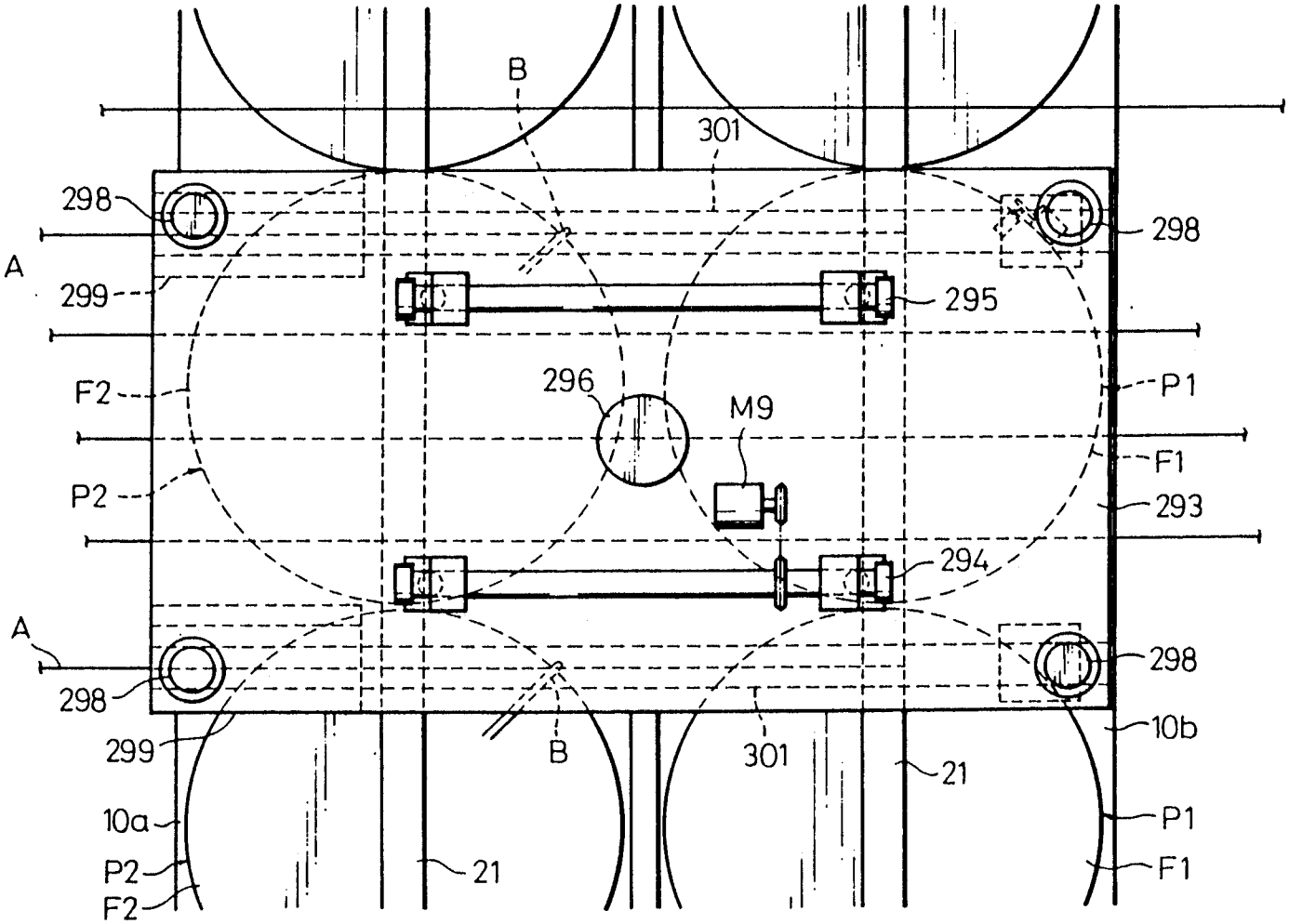
FIG. 17 is a plan view of the sliver piecing device applied to the second embodiment shown in FIG. 15.

Next, the sliver position regulating device 220 is explained in detail. As shown in FIG. 15, the conveyers 210*a* and 210*b* of each conveyer means 210 are provided respectively with a can turning device 231 at the cans supply side thereof. The construction and function of the can turning device 231 are same as those of the device shown in FIG. 4. A device SW3 for sensing a sliver end B from the full packaged sliver cans F2 is disposed on the can turning device 231, as shown in FIG. 16, and this sensing device functions to position the sliver end B on an imaginary vertical plane where the sliver A from the sliver cans F1 passes thereon in a region between the feed rollers 21 of the creel.

Figure 18:
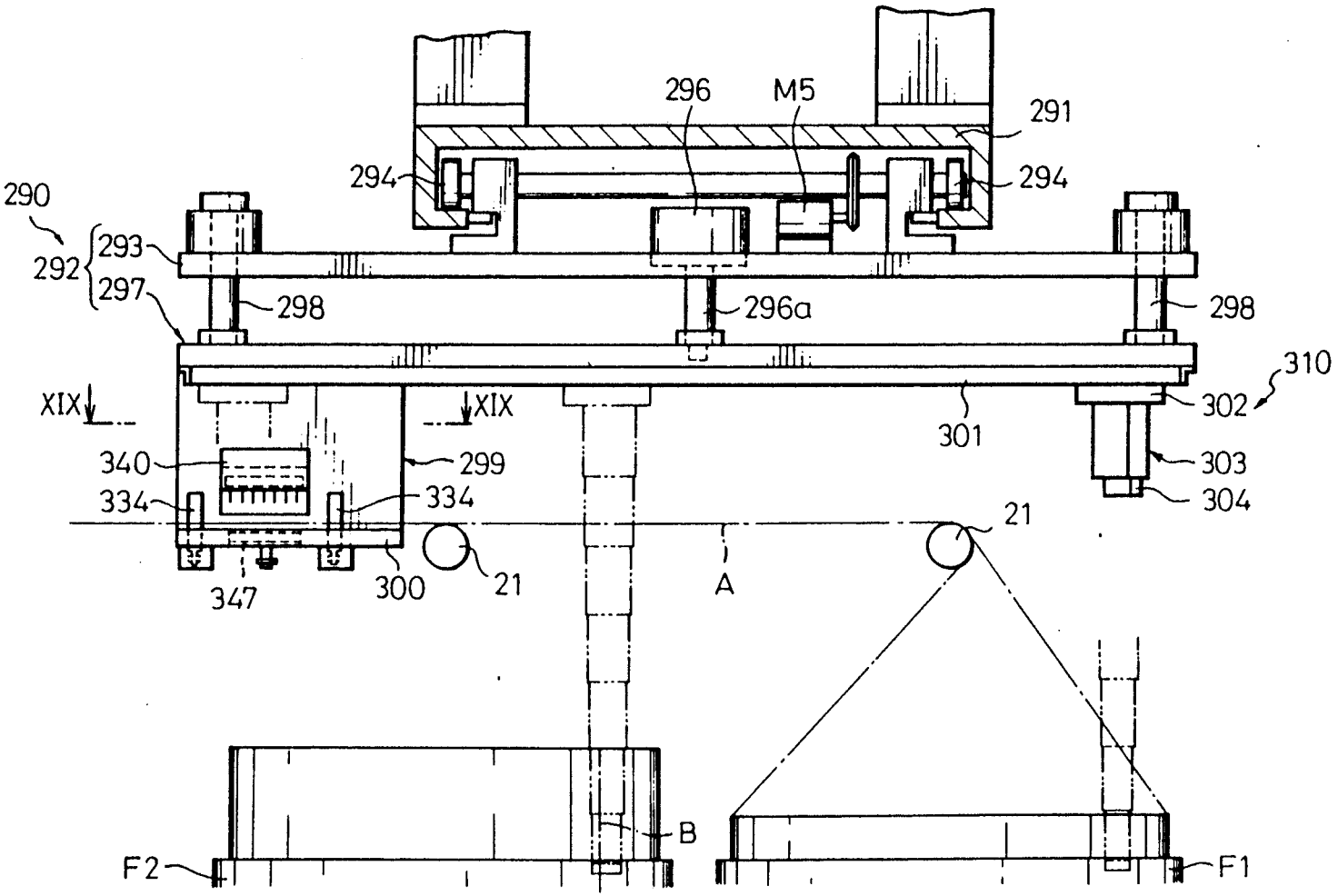
FIG. 18 is a side elevation of the device shown in FIG. 17.

Next, the sliver piecing device 290 applied to this second embodiment is explained in detail. Referring to FIG. 18, a guide rail 291 for guiding the sliver piecing device 290 is arranged above the feed rollers 21 arranged at respective positions above the conveyer means 210 composed of conveyers 210*a* and 210*b*, along the longitudinal direction of the conveyers 210*a* and 210*b*. A pair of driving wheels 294 and a pair of driven wheels 295 are rotatably supported by a base 293 of a main body 292 of the device 290 and a shaft of the driving wheels 294 is driven by a motor M9 rigidly mounted on the base 293 of the device 290, to run the driving wheels 294 and 295 along a pair of guide rails 291. Below the base 293 is arranged a body 297, which is connected to a piston rod 296*a* of a cylinder 296 rigidly mounted the base 293, displaceable upward and downward on four guide rods 298 arranged a four corners thereof, by a lifting cylinder 296 connected thereto. Pairs of projections 299 having an L shaped cross section (FIG. 20), which are projected downward, are secured to the body 297, and the bottom surfaces thereof form table plates 300 respectively. These table plates 300 are positioned below the supplied sliver A to be subjected to the sliver piecing operation and extending between feed rollers 21, when the sliver piecing operation is carried out. The pitch of the downward projections 299 is identical to an outside diameter of the sliver cans F1, F2.

Figure 22:
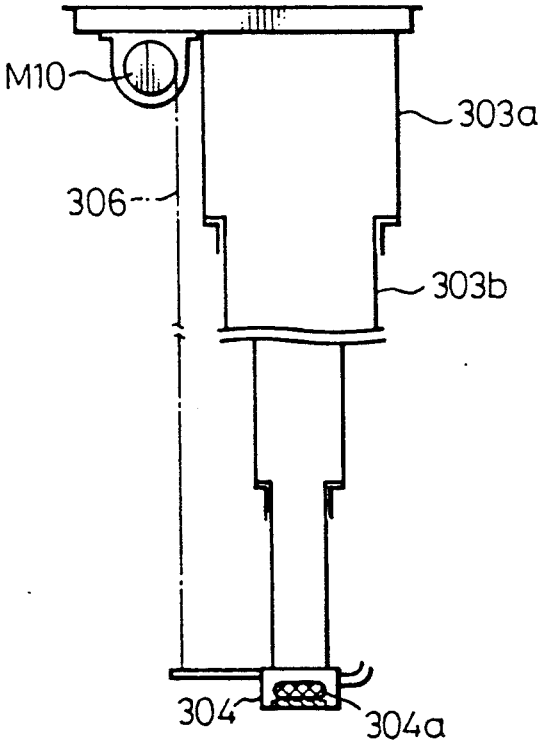
FIG. 22 is an explanatory drawing of a telescopic arm applied to the second embodiment shown in FIG. 15.
Figure 23:
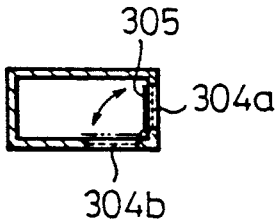
FIG. 23 is a sectional view of a suction device applied to the second embodiment of the present invention shown in FIG. 15.

A rodless cylinder 301, such as shown in U.S. Pat. No. 4,164,893 (Sealing device at Pressure Fluid Cylinder), is secured to the body 297 at a position above the table plate 300, in parallel to the supplied sliver A and extending over the conveyers 210*a* and 210*b* of the conveyer means 210. A telescopic arm 303 is secured to a mounting 302 of the rodless cylinder 301 and can be expanding or contracted. This telescopic arm 303 is provided with a suction device 304. As shown in FIG. 22, the telescopic arm 303 is provided with a plurality of guide cylinders, wherein each of two adjacent guide cylinders are telescopically connected, as indicated in FIG. 22, such as a combination of a guide cylinder 303*a* with another guide cylinder 303*b* having an outside diameter smaller than an inside diameter of the guide cylinder 303*a* and rotation of the guide cylinder 303*b* inside the guide cylinder 303*a* is prevented so that the telescopic arm 303 can be expanded and contracted along its longitudinal axis. The suction device 304 is provided with a pair of suction mouths 304*a* and 304*b* at a side wall and bottom surface thereof, and a damper 305 is disposed inside the suction device 304 to change the direction of the suction force towards the suction mouth 304*a* or suction mouth 304*b*. The telescopic arm 303 is expanded or contracted by a chain 306 which is driven to be lengthened or shortened by a motor M10 mounted on the mounting 302. In the most contracted condition of the telescopic arm 304, the suction device 304 is positioned above the table plate 300 (FIG. 18), and in the most expanded condition of the telescopic arm 303, the suction device 304 is positioned along side the sliver end B from the full packaged sliver cans F2.

The rodless cylinder 301, the telescopic arm 303, the suction device 304, and the motor M10 construct the catching device 310 by which the sliver end B from the full packaged sliver cans F2 positioned at the standby position P2 is caught, and the sliver end B is then positioned on the table plate 300 by the feed rollers 21. As the above-mentioned telescopic cylinder, the telescopic means disclosed in Japanese Unexamined Patent Publication Showa 63 (1988)-272490 can be utilized.

Figure 20:
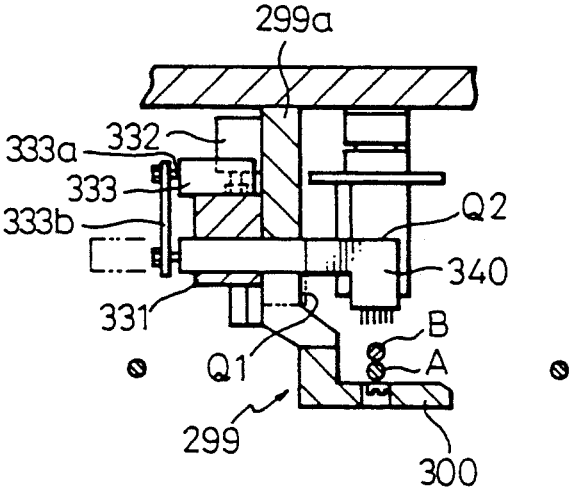
FIG. 20 is a sectional view of the device shown in FIG. 19, taken along the line XX—XX.
Figure 21:
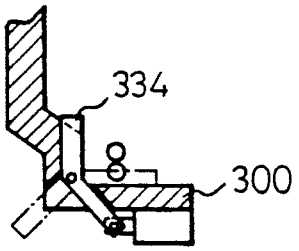
FIG. 21 is a sectional view of the device shown in FIG. 19, taken along the line XXI—XXI.

Next, the sliver piecing device utilized for the second embodiment is explained in detail. In this embodiment, the sliver piecing device disclosed in Japanese Examined Patent Publication Showa 44 (1969)-27492 is applied. Namely, as shown in FIG. 20, a slider 331 is slidably mounted on a back surface of a vertical wall 299*a* of a downwardly projected portion 299, and is displaceable thereon upward and downward. A sliver piecing head 340 is provided and is displaceable from a standby position Q1 for a predetermined distance on the horizontal plane.

Figure 24:
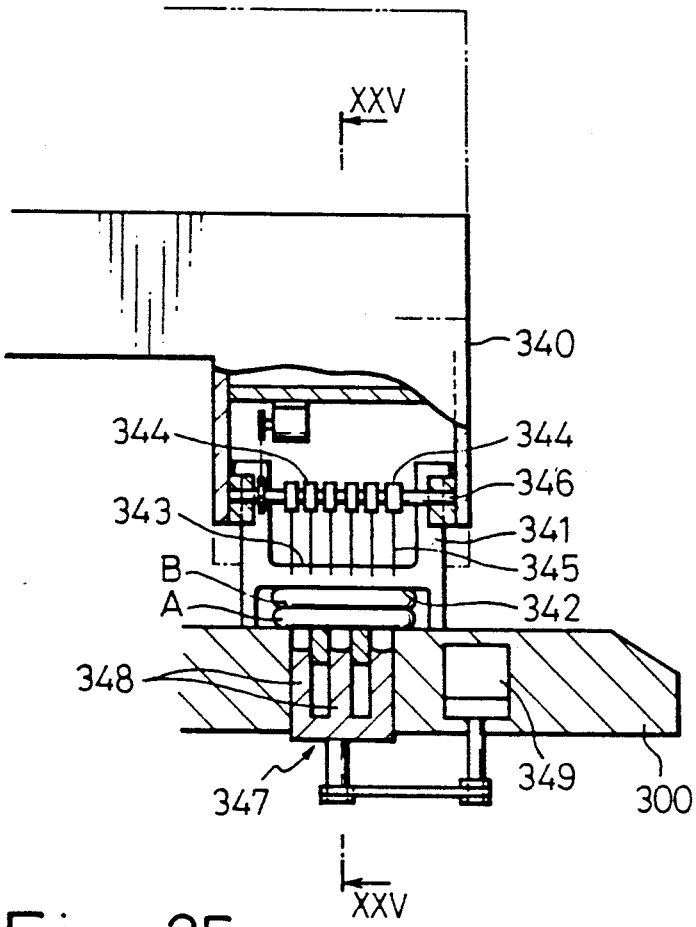
FIG. 24 is a front view of a sliver piecing head applied to the second embodiment of the present invention shown in FIG. 15.
Figure 25:
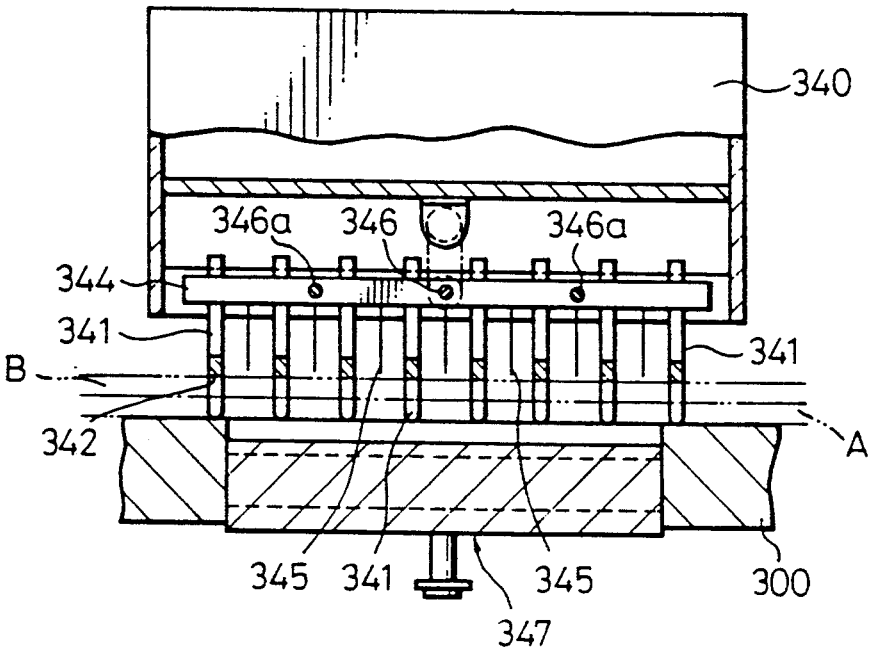
FIG. 25 is a cross sectional view of the device shown in FIG. 24, taken along the line XXV—XXV.
Figure 26:
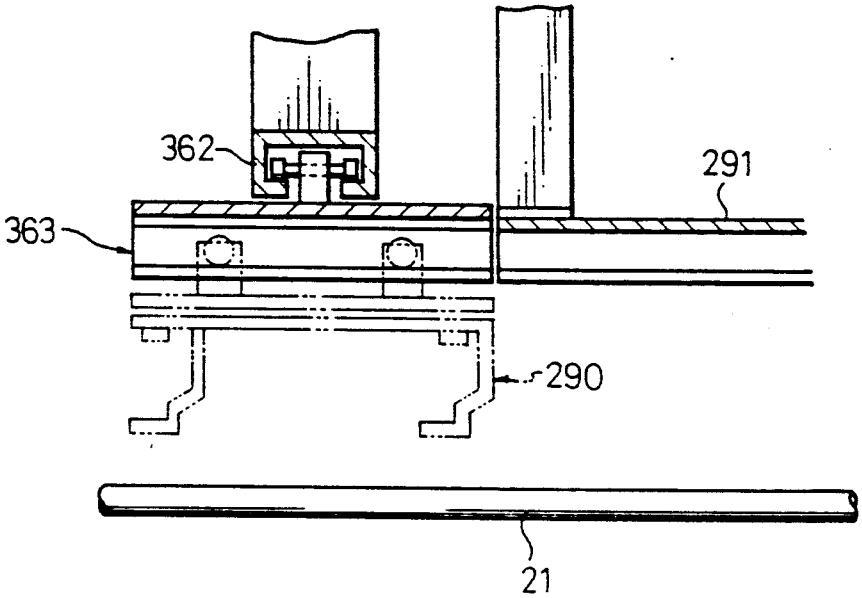
FIG. 26 is an explanatory drawing of a carrier for the sliver piecing device applied to the second embodiment of the present invention shown in FIG. 15.

The sliver piecing head 340 is connected to a displacing cylinder 333, and folded sliver clampers 334 are swingably mounted to the vertical wall 299*a* of the downwardly projected portion 299 at both sides of the sliver piecing head 340, and these sliver clampers 334 are actuated by respective cylinders. A plurality of plates 341, which expand the doubled portion consisting of the sliver end B from the full packaged sliver cans F2 and the supplied sliver A, are dispalceably mounted in the sliver piecing head 340, as shown in FIG. 24. The plate 341 is H-shaped, and a lower recessed portion 342 thereof catches a part of the sliver A and the end B of the sliver from the full packaged cans F2, to expand the doubled portion of the sliver ends A and B. Further, a plurality of bars 344 are arranged in the upper recessed portion 343 and are directed along the sliver A, and a needle 345 is mounted to each bar 344 in a space between two adjacent plates 341. As shown in FIG. 25, the bars 344 are slidably mounted on a pair of guide rods 346*a* and screw engaged with a screw shaft 346 at the center thereof. The screw shaft is provided with a right hand thread and a left hand thread formed alternately thereon, and accordingly, the distance between two adjacent bars 344 can be changed from the condition shown in FIG. 24 to the condition shown in FIG. 27, by rotating the screw shaft 346, thereby a thin sliver expanded in the lateral direction of the doubled portion of the slivers A and B is formed.

Figure 27:
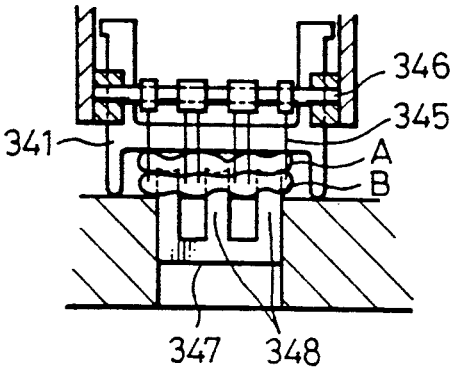
FIG. 27 is an explanatory drawing of the sliver piecing operation by the second embodiment of the present invention, shown in FIG. 15.

A sliver pushing plate 347 is arranged such that, when the sliver piecing operation is carried out, the sliver pushing plate 347 takes a position below the sliver piecing head 340, which is projected to the position Q2 to carry out the sliver piecing operation, on the table plate 300. The sliver pushing plate 347 is displaceable upward and downward, and is provided with projecting portions 348 which correspond to a thin sliver portion, as shown in FIG. 27. A device 350 for separating an excess portion of the sliver A from the sliver can F1 on the table plate 300 comprises a sliver clamp located at the rear thereof and the above-mentioned catching device 310.

In this embodiment, a discharge conveyer 360 for transferring the exhausted sliver cans to the drawing process is arranged at the discharging side of the conveyer means 210, and another conveyer 361 for transferring the full packaged sliver cans F2 from the drawing process is arranged adjacent to the above-mentioned can positioning device 220, as shown in FIG. 15. A rail 362 for guiding the carrier of the sliver piecing device 290 is suspended from the ceiling of the factory building at the cans discharging side of the rail 291, and a carrier 363 is suspended from the rail 362 and displaceable along the alignment of ends of the conveyers 210*a*, 210*b*. A sliver can pushing device 364 arranged at a side of the conveyer 361 for carrying full packaged sliver cans is displaceable along the conveyer 361.

Next the function of the second embodiment is explained in detail. As shown in FIG. 15, the sliver supply positions P1 are prefixed on the respective conveyers identified by the numbers (2), (3), (6) and (7), and the sliver cans F1 are mounted at the respective positions P1.

In this embodiment, the sliver cans F1 on the conveyer of (2) are almost exhausted sliver cans, the sliver cans F1 on the conveyer (3) are cans which will be exhausted after the sliver cans on the conveyer (2) are exhausted, and contain almost one-fourth of the volume of the full packaged sliver cans. Therefore, full packaged sliver cans must be supplied to the conveyer (4), and accordingly, the full packaged sliver cans F2 are carried by the conveyer 361 toward the supply positions of the conveyer (4). In the conveyer 361, the pin 15 of the position deciding device 13 is projected to stop the displacement of the full packaged sliver cans F2 at the supply position to the conveyer (4), and thereafter, the pushing device 364 is actuated to push the full packaged sliver can F2 onto the can turning device 231. Accordingly, the full packaged sliver can F2 is turned about its longitudinal axis, as in the first embodiment, and when the device SW3 detects the sliver end B, the turning motion of the full packaged sliver can F2 is stopped so that the sliver end B thereof can be positioned at a predetermined angular position with respect to the longitudinal axis of the full packaged sliver cans F2. Thereafter, the full packaged sliver cans F2 are transferred onto the conveyer (4). The above-mentioned operation is repeated to supply the predetermined number of full packaged sliver cans F2 onto the conveyer (4), and these full packaged sliver cans F2 are arranged at the respective standby positions P2 on the conveyer (4) such that the full packaged sliver cans F2 face the corresponding sliver cans F1 on the conveyer (3). According to the above-mentioned operation, each sliver end B of the full packaged sliver cans mounted at the respective positions P2 is positioned on an imaginary vertical plane whereon the sliver A from the corresponding sliver can F1 which is supplying to the roving frame is passing.

Next the sliver piecing operation of the second embodiment is explained in detail, mainly with reference to FIG. 15. As shown in FIG. 15, the sliver supplying cans F1 arranged on the conveyer (2) are almost exhausted, while full packages sliver cans F2 have been already mounted on the conveyer number 1. The sliver piecing device 290 is displaced from the right side to the left side in FIG. 15, such that the table plate 300 is positioned above the feed rollers 21 (see FIG. 18). When the lower projected portion 299 of the sliver piecing device 290 is positioned between the supplying sliver A from a sliver can F1, which must be pieced with the sliver end B of the corresponding full packaged sliver cans F2, and the end of the sliver from the full packaged sliver can F2 taking a position at the opposite side to the direction of displacement of the sliver piecing device 290, the body 297 is displaced downwards by the cylinder 296, and the table plate 300 is positioned below the sliver A, which extends over the feed rollers 21. At this stage, the downward projected portion 299 is displaced for a predetermined distance toward the direction of displacement of the piecing device 290, so that the sliver A is mounted on the table plate 300, and then the two sliver clampers 334 clamp the sliver A on the table plate 300. The telescopic arm 303 sucks the sliver A at a position which is to the right of the right side clamper 334 (in FIG. 18), in the most contracted condition thereof, and the telescopic arm 303 is further displaced to the right (in FIG. 18) so that the sliver A is separated from the sliver coming from the sliver can F1, so that a fresh free end of sliver which is ready to be supplied to the roving frame 1 is created. The sliver connected to the sliver coming from the sliver can F1 is then positioned above the sliver cans F1 by the telescopic arm 303, and at this position the sliver portion connected to the remaining sliver in the sliver cans F1 is released from the suction force of the suction device 304 of the telescopic arm 303 so that the above-mentioned sliver connected to the remained sliver is dropped into the sliver can F1. Next the telescopic arm 303 is displaced to the left in FIG. 18 and stopped at a position right above the sliver end B of the corresponding full packaged sliver cans F2 on the conveyer (1), and the telescopic arm 303 is then extended. The extended telescopic arm 303 sucks the sliver end B of the full packaged sliver cans F2 and the telescopic arm 303 is again contracted, to elevate the suction device 304 upward, and displaced to the left side end of the body 297, while the clamping action of the right side clamper 334 is released. Next the right side clamper 334 is actuated to clamp the above-mentioned fresh free end of sliver and the suction of the suction device 304 is stopped, so that this fresh end of the sliver and the sliver end B are doubled together, and the telescopic arm 303 is then displaced to the right side end of the body 297. At this stage, the sliver piecing head 340, which is at the standby position, is displaced to a position right above the doubled portion of these sliver ends, and then displaced downwards. During this downward displacement of the sliver piecing head 340, the plate 341 is first brought into contact with the upper surface of the table plate 300, so that the doubled portion of these sliver ends is spread in the width direction thereof. Referring to FIGS. 24 and 25, when the sliver piecing head 340 is displaced downward, the needles 345 are displaced downward while maintaining the position of the plate 341, and the needles 345 are pushed into the doubled portion of these sliver ends. Then, to create a thin portion in the above-mentioned doubled portion, the screw shaft 346 is rotated, and thereafter, the lower side of the doubled portion, which is occupied by the fresh free end of sliver where the needles 345 do not work, is pushed upward toward the upper thin portion of the doubled portion by the sliver pushing plate 347 to mix the fibers forming these sliver ends, and thereby the sliver piecing operation for the sliver end B and the sliver A is completed. In the above-mentioned sliver piecing operation, the sliver piecing device 290 is displaced slightly toward the right in FIG. 18, and the body 297 is displaced upward such that the lower projected portion 299 is positioned below the sliver A which is supplying from the sliver can F1. The sliver piecing device 290 is then displaced to a position above the full packaged sliver cans F2 at which the sliver piecing operation is successively to be carried out. The above-mentioned unit sliver piecing operation is carried out successively for all full packaged sliver cans F2 on the conveyers (1), and when this series of sliver piecing operations is completed, the sliver piecing device 290 is suspended from the carrier 363 and then carried to a position next to the next conveyer means at which the sliver piecing operation is to be carried out. In the above-mentioned embodiment, the full package sliver cans F2 are always supplied to a conveyer closer to the roving frame than the other conveyer forming an identical conveyer means, but the above-mentioned operation can be successfully applied to the case in which the full packaged sliver cans F2 are always supplied to the other conveyer in each conveyer means.

Figure 19:
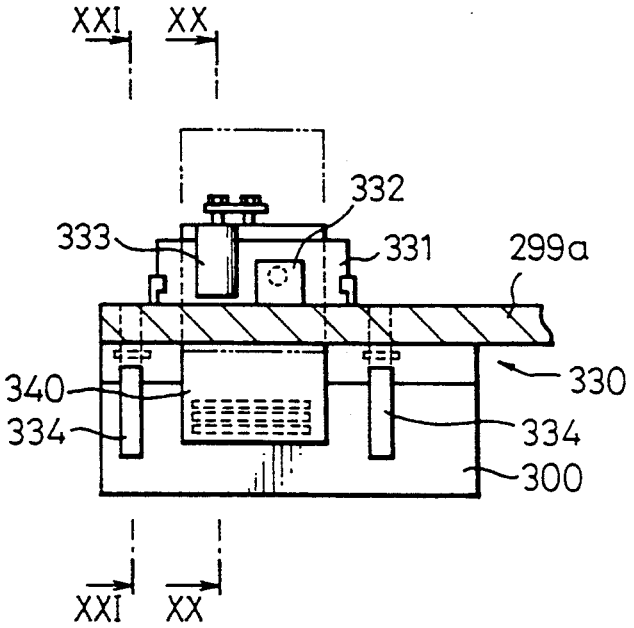
FIG. 19 is a sectional view of the device shown in FIG. 18, taken along the line XIX—XIX.
Figure 28:
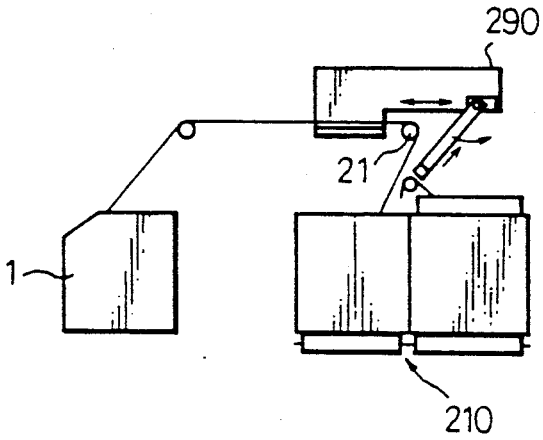
FIG. 28 is a schematic side view of another embodiment of the present invention.

In the second embodiment, the sliver separating device 350 is mainly constructed by the sliver catching device 310 and the right side clamper 334 (in FIG. 19), and therefore the construction of the device 350 is greatly simplified. The sliver separating device may be arranged separately from the sliver piecing device 90. And if the function of the telescopic arm 303 is modified such that the arm 303 can be swung forward and rearward at a position of mounting the rodless cylinder 346, the telescopic arm 303 can be utilized when a feed roller 21 is arranged at a position between two conveyers **210*a* and 210*b* of the conveyer means, as shown in FIG. 28**, and the sliver hanger of the first embodiment is utilized. Also, the sliver piecing device utilized for the second embodiment can be used for the third prior art mentioned in the "RELATED ART SECTION". In this embodiment, the regulation of the angular position of the sliver end B is carried out such that the sliver end B is positioned at a predetermined angle outside the sliver cans with respect to the axial center of the sliver cans, and the following modification are applied. Namely, when a free end of the sliver contained in a full packaged sliver can is created on a full packaged sliver can produced by a drawing frame, if the end portion of sliver is made in a condition that this portion of sliver passes laterally through a cross sectional center of the cans at the top surface of the last sliver coil, it makes a condition wherein the sliver end B can be fixed at a particular position such that the catching of the sliver end B can be easily carried out.

In the second embodiment of the present invention, the sliver end B of the full packaged sliver cans F2 is particularly positioned on an imaginary vertical plane where supplying sliver to the roving frame via the feed rollers 22 passes, therefore, it is only necessary to control the motion of the catching device, which moves upward, downward, forward, and rearward, to carry out the sliver piecing operation, and therefore, the construction of the control device is simplified. Further, since the sliver piecing motion is carried out for two sliver ends positioned closely, the time needed to complete the sliver piecing operation can be shortened.

In both embodiments, since after creating a free end of the sliver which is supplied to the roving frame 1, by separating from the sliver coming from the sliver can F1, the operation to displace the remaining portion of sliver connected to the sliver coming from the can F1 towards a position above the can F1 is carried out by the sliver piecing device itself, and thus a special device for this carrying operation can be omitted whereby the construction of the apparatus can be simplified.

As mentioned above, according to the first and second embodiments of the present invention, it is possible to mechanically piece the free end of the supplying sliver which was created by the sliver from the sliver can F1, and the sliver end B of the full packaged sliver cans F2 at the position P2, and therefore, the sliver piecing operation mentioned above can be continuously carried out without a manual operation.

As already explained, according to the apparatus of the present invention, full packaged sliver cans F2 are arranged at standby positions before starting the sliver piecing operation, and thus it is easy to control the motion of the gripping device of the sliver piecing device. Further, since a full packaged sliver can F2 is prepared at a position adjacent to a sliver can F1, the automatic sliver piecing operation of two sliver ends related to those cans F1 and F2 can be easily carried out. A further advantage of the present invention is that the sliver piecing operation can be carried out by introducing a free end of a sliver from a full packaged sliver can F2 to a position close to a sliver supplying can F1, without waiting for the emergence of an end of sliver from a can F1 facing the full packaged sliver can F2.

Therefore, it is not necessary to precisely control the volume of sliver contained in full packaged sliver cans.

In the first embodiment, the first sliver catching device for catching the sliver end B of the full packaged sliver can at the standby position and the second sliver catching device for catching the supplying sliver A are used separately, and since the operations of these two catching devices are started simultaneously, an advantage is gained in that the sliver piecing operation is completed in a short time. Further, since the sliver piecing operation is carried out at a position below the feed rollers of the sliver creels, the length of the catching arm of the above-mentioned catching devices can be made shorter, and accordingly, the overall size of the sliver piecing device can be reduced.

In the second embodiment of the invention, since a table plate, mounted on the main body of the sliver piecing device, can be positioned below the supplying sliver extending over feed rollers, when carrying out the sliver piecing operation, the sliver piecing operation is carried out thereon, and therefore, the introduction of the free end of the sliver from the full packaged sliver can F2 onto the table plate by the corresponding feed roller is sufficient to carry out the sliver piecing operation, and thus the catching device for catching the supplied sliver as in the first embodiment can be omitted, and accordingly, the construction of the sliver piecing device is simplified as compared with the first embodiment. Also, since the sliver piecing device is positioned above the feed rollers of the creel during the sliver piecing operation, the second embodiment has an advantage such that the sliver piecing device can be freely designed without considering the restriction of size thereof, a very practical design of the sliver piecing operation can be accomplished.

Further, since the sliver supply device according to the present invention utilizes a conveyer means, whereon the sliver supply position of each supply can is set, and the supply side and discharge side of this conveyer means are connected to the drawing process by a separate conveyer means, respectively, if the present invention is combined with the known automatic sliver cans transportation system between the carding process and the drawing process, known automatic sliver supply system, the known automatic system for transportation of roving bobbins from the roving process to the ring spinning process, the known automatic roving bobbin exchanging system in the ring spinning process, then as a result the manual transportation of the spinning material and manual piecing operating of slivers from the carding process to the ring spinning process can be eliminated, and thus the present invention makes a remarkable contribution to the establishment of a spinning mill operated without a manual operation. Accordingly, the present invention will make a remarkable contribution to the establishment of a modern spinning mill characterized by an automated spinning process.

We claim:

1. An improved method of continuously supplying slivers to a roving frame provided with a plurality of drafting units, including an automatic piecing operation of a sliver coming from a sliver supply can with a corresponding free end of a sliver from a full packaged sliver can, wherein a plurality of sliver cans are arranged in each of a plurality of spaces formed along a longitudinal direction of said roving frame in parallel to each other, while said slivers are supplied from respective sliver cans to the corresponding drafting units of said roving frame, in a supply condition such that the arrangement of said sliver cans between said spaces with respect to the volume of sliver contained therein is maintained in a tapered condition, comprising, forming each one of said spaces as a pair of parallel units spaces, each of said unit spaces being capable of arranging an alignment of said sliver cans for supplying sliver to a corresponding one of said drafting units, and said full packaged sliver cans, mechanically arranging full packaged sliver cans in either one of said unit spaces of a particular one of said spaces, wherein said supply sliver cans for supplying sliver to said roving frame, are arranged in another unit space thereof and contain a smallest volume of sliver in comparison with other sliver cans arranged in said spaces, except for said particular spaces, by regulating a standby position of each of said full packaged sliver cans at a position facing the corresponding one of said sliver supplying cans, regulating an angular position of said free end of sliver from each one of said full packaged sliver cans with respect to a longitudinal axis of said full packaged sliver can at a predetermined angular position when said full packaged sliver cans are arranged in said unit space of said particular space, mechanically piecing said free ends of said supplied slivers with corresponding free ends of slivers from said full packaged sliver cans arranged at said standby positions facing corresponding said sliver cans in an exhausted condition, with respect to sliver supply cans of said particular space, carrying out said unit sliver piecing operation for all sliver supplying cans in an identical alignment under a condition of mixing slivers of free end portions of both said slivers, thereafter discharging said sliver cans at which said sliver end piecing operation is completed from said unit space of said particular space, applying said unit operation composed of said sliver piecing operation and discharging operation of sliver supply cans in an exhausted condition to all of said sliver supply cans at other spaces according to a consumption of sliver in each sliver supply cans, one space by one space, of said space arrangement.

2. A method of continuously supplying slivers to a roving frame according to claim 1, wherein said operation of piecing free ends of slivers is carried out during a period in which the driving of said roving frame is stopped.

3. A method of continuously supplying slivers to a roving frame according to claim 1, wherein said unit operation of piecing sliver ends comprises, first clamping a part of a sliver from said sliver supplying can and then separating said sliver into two portions so that a free end of said sliver is formed, said sliver being supplied to said draft part of said roving frame, second carrying said free end of said sliver to a position for carrying out said piecing operation, and simultaneously, carrying said free end of sliver from said full packaged sliver can facing a corresponding one of said sliver cans to said position for carrying out said piecing operation, piecing said two free end of slivers together by doubling thereof while interlacing component fibers of these two sliver ends, and carrying out said operations mentioned above mechanically.

4. A method of continuously supplying slivers to a roving frame according to claim 1, wherein said unit operation of piecing sliver ends comprises, forming a free end of a sliver supplied to said draft part of said roving frame by separating said sliver from said sliver supplying can at a position in a passage for carrying out said sliver piecing operation along a substantially horizontal passage for supplying sliver to said draft part, clamping said free ends of a sliver from said full packaged sliver can facing a corresponding one of said sliver cans and displacing same to a position of an imaginary vertical plane where said horizontal passage of said sliver is included, from an upper side thereof, doubling said two sliver ends and spreading said doubled portion of said sliver ends and mixing component fibers of an upper side of said double portion to form component fibers of a lower side of said doubled portion so that two ends of slivers are pieced as one sliver body.

* * * * *